US012297027B2

(12) United States Patent
Dauzvardis et al.

(10) Patent No.: US 12,297,027 B2
(45) Date of Patent: May 13, 2025

(54) BASE OF A PLASTIC CONTAINER

(71) Applicant: Envases USA, Inc., Amherst, NH (US)

(72) Inventors: Matt Dauzvardis, Manhattan, IL (US); Andrea Delgado Hernandez, Manchester, NH (US)

(73) Assignee: Envases USA, Inc., Amherst, NH (US)

( * ) Notice: Subject to any disclaimer, the term of this patent is extended or adjusted under 35 U.S.C. 154(b) by 0 days.

(21) Appl. No.: 18/590,448

(22) Filed: Feb. 28, 2024

(65) Prior Publication Data

US 2024/0199298 A1 Jun. 20, 2024

Related U.S. Application Data

(62) Division of application No. 17/833,339, filed on Jun. 6, 2022, now Pat. No. 11,970,324.

(51) Int. Cl.
*B65D 79/00* (2006.01)
*B65D 1/02* (2006.01)

(52) U.S. Cl.
CPC ..... *B65D 79/0081* (2020.05); *B65D 1/0276* (2013.01); *B65D 79/0084* (2020.05); *B65D 2501/0018* (2013.01)

(58) Field of Classification Search
CPC ..... B65D 1/0276; B65D 79/0081; B65D 2501/0036
USPC ..... 220/609
See application file for complete search history.

(56) References Cited

U.S. PATENT DOCUMENTS

| | | | | |
|---|---|---|---|---|
| 3,468,443 | A * | 9/1969 | Marcus | B65D 1/0284 220/606 |
| 4,247,012 | A * | 1/1981 | Alberghini | B65D 1/0276 215/373 |
| 5,632,397 | A | 5/1997 | Fandeux et al. | |
| 6,065,624 | A * | 5/2000 | Steinke | B65D 1/0276 220/675 |
| 6,176,382 | B1 | 1/2001 | Bazlur Rashid | |
| 6,595,380 | B2 | 7/2003 | Silvers | |
| 6,942,116 | B2 | 9/2005 | Lisch et al. | |
| 7,150,372 | B2 | 12/2006 | Lisch et al. | |
| 7,416,089 | B2 | 8/2008 | Kraft et al. | |
| D627,652 | S | 11/2010 | Dorn | |
| 8,276,774 | B2 | 10/2012 | Patcheak et al. | |
| 8,353,415 | B2 * | 1/2013 | Saito | B65D 1/0261 215/373 |

(Continued)

*Primary Examiner* — James N Smalley
*Assistant Examiner* — Jennifer Castriotta
(74) *Attorney, Agent, or Firm* — Finch & Maloney PLLC

(57) ABSTRACT

A plastic container has a base portion adapted for vacuum absorption, the container including a base and a body extending up from the base along a central axis to a finish portion defining a mouth. The base includes an outside wall, a chime connecting the outside wall to an annular contact ring, an inside wall extending upward from the contact ring to a hinge, and a diaphragm connected to the hinge. The diaphragm can move between first and second positions in response to pressure change within the container. The diaphragm includes a central region and a flexible wall having a curved profile in cross section. The flexible wall curves downward from the hinge to the central region. In some embodiments, the flexible wall is asymmetric and includes a first portion having a curved profile and a second portion having a linear profile. A container wall structure is also disclosed.

9 Claims, 12 Drawing Sheets

(56) References Cited

U.S. PATENT DOCUMENTS

| | | | | |
|---|---|---|---|---|
| 8,561,822 | B2 | 10/2013 | Beck et al. | |
| 8,616,395 | B2 | 12/2013 | Patcheak et al. | |
| 8,678,213 | B2 | 3/2014 | Boukobza | |
| 8,833,579 | B2 | 9/2014 | Patcheak et al. | |
| 8,950,611 | B2 | 2/2015 | Derrien et al. | |
| 8,998,026 | B2 | 4/2015 | Nakayama et al. | |
| 9,085,387 | B2 | 7/2015 | Kurihara et al. | |
| 9,242,762 | B2 | 1/2016 | Imai et al. | |
| 9,394,072 | B2 | 7/2016 | Patcheak et al. | |
| 9,463,900 | B2 | 10/2016 | Nakayama et al. | |
| 9,650,207 | B2 | 5/2017 | Nakayama et al. | |
| 9,751,679 | B2 | 9/2017 | Stelzer et al. | |
| 9,828,166 | B2 | 11/2017 | Bouffand et al. | |
| 9,884,714 | B2 | 2/2018 | Godet | |
| 9,994,378 | B2 | 6/2018 | Wurster et al. | |
| 10,029,817 | B2 | 7/2018 | Wright et al. | |
| 10,053,276 | B2 | 8/2018 | Godet et al. | |
| 10,059,482 | B2 | 8/2018 | Mast et al. | |
| 10,065,766 | B2 * | 9/2018 | Boukobza ..... | B65D 23/001 |
| 10,343,832 | B2 | 7/2019 | Godet | |
| 10,518,924 | B2 | 12/2019 | Woloszyk et al. | |
| 10,597,213 | B2 | 3/2020 | Usami et al. | |
| 10,968,006 | B2 | 4/2021 | Woloszyk et al. | |
| 2009/0242575 | A1 * | 10/2009 | Kamineni ..... | B65D 79/0081 220/608 |
| 2010/0163513 | A1 | 7/2010 | Pedmo | |
| 2011/0049083 | A1 * | 3/2011 | Scott ..... | B65D 1/0276 215/371 |
| 2016/0346986 | A1 | 12/2016 | Van Dijck et al. | |
| 2020/0095008 | A1 | 3/2020 | Woloszyk et al. | |

* cited by examiner

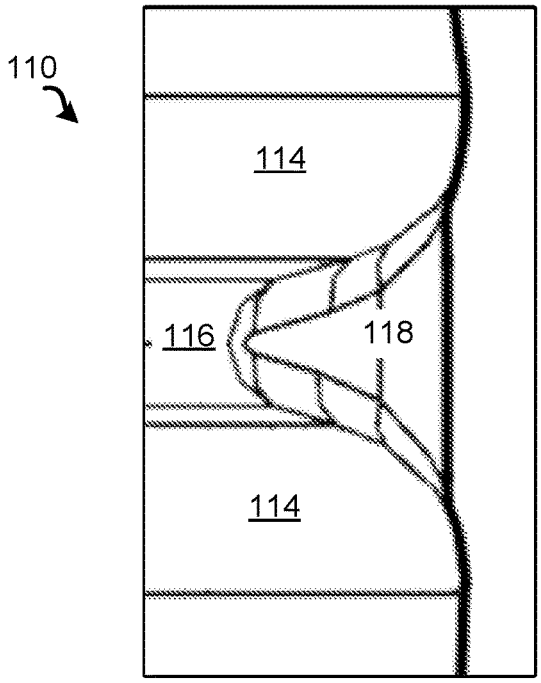
FIG. 15 Detail B
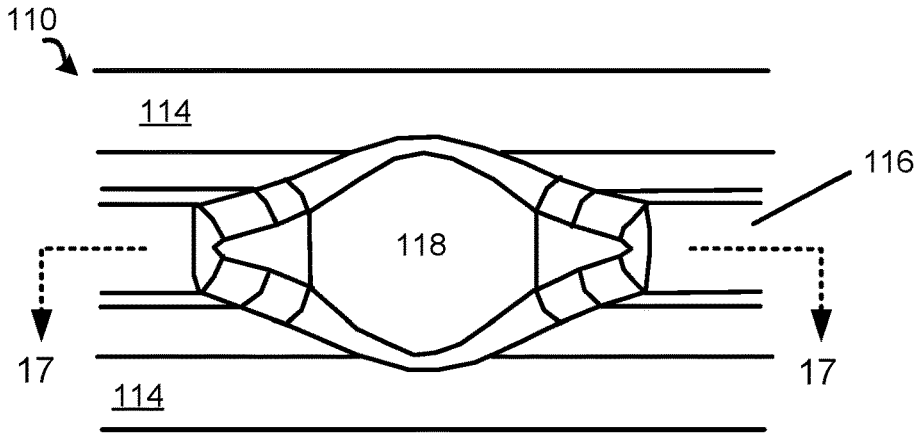
FIG. 16 Detail C
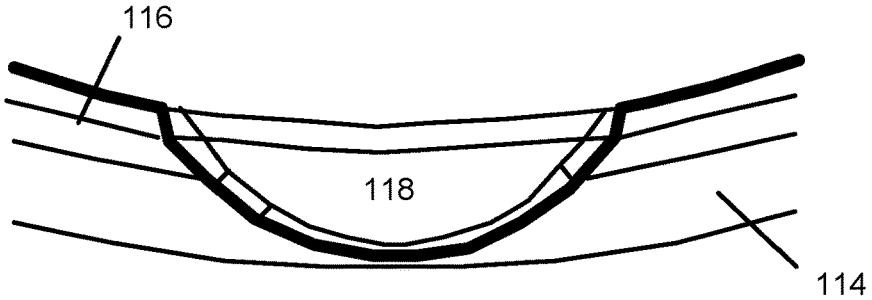
FIG. 17

BASE OF A PLASTIC CONTAINER

RELATED APPLICATIONS

This application is a divisional application of, and claims priority to, U.S. patent application Ser. No. 17/833,339, filed on Jun. 6, 2022, the contents of which are incorporated herein by reference in its entirety.

TECHNICAL FIELD

The present disclosure relates to plastic beverage containers and more specifically to a base of a plastic beverage container that is responsive to pressure changes within the container.

BACKGROUND

Plastic containers for packaging beverages are commonly fabricated from polyesters such as polyethylene terephthalate (PET). These containers are lightweight, inexpensive, and recyclable and can be economically manufactured in large quantities.

These containers are typically manufactured using the stretch blow molding process. This involves the use of a preform that is injection molded into the desired final shape of the container. The preform is first heated, stretched and subsequently inflated within a mold cavity so that it assumes the desired final shape of the container. As the preform is inflated, it takes on the shape of the mold cavity. The polymer solidifies after contacting the cooler surface of the mold, and the finished hollow container is subsequently ejected from the mold.

Such containers are common for use in packaging beverages using what is known in the industry as the hot-fill process. This involves filling the containers while the liquid product is at an elevated temperature in order to sterilize the container at the time of filling. Containers that are designed to withstand the process are known as "hot fill" type containers. After filling, such containers undergo significant volumetric shrinkage as a result of the product cooling within the sealed container. Hot fill type containers accordingly must be designed to have the capability of accommodating such shrinkage. Typically, this has been done by incorporating concave vacuum panels into the side wall of the container that are designed to flex inwardly as the volume of the product within the container decreases as a result of cooling. More recently, it has been proposed to accommodate such volumetric shrinkage by providing a movable vacuum panel in the bottom of the container.

In some instances, it is desirable for a plastic container to be formed with a deep inset base, i.e., a base that is shaped to have a relatively tall and narrow standing ring. For example, a deep inset base may extend upward from the bottom of the container upward such that the form of the base is concave. A deep inset base may be desirable for any one of a variety of different reasons, including but not limited to the placement of a movable vacuum panel in the bottom of the container. For example, a manufacturer may desire to place an article in the space that is defined by the container bottom, or a deep inset base may be desirable in order to facilitate stacking containers vertically.

Depending on filling process, the bottle can be supported from the neck, or it may sit on its base during fill. Pressure from top can be significant during fill, causing base to sag ("base roll out") below the heel until the container cools and pulls up. The Base roll out can cause bottom of the container to be pushed out in a convex shape such that the container easily tips over on conveyor.

Unfortunately, it has been problematic in the past to manufacture a container having a deep inset base using the reheat stretch blow-molding process. Efforts to produce such containers often resulted in unwanted extreme stretching and thinning of the container wall in the area of the standing ring of the container base, thereby causing crimping or folding of the standing ring, or other unwanted deformities in the bottom of the container. These problems made it practically impossible for a container to have a deep inset base. A need exists for an improved container having a deep inset base and an improved method for manufacturing such a container.

SUMMARY

One aspect of the present disclosure is directed to a plastic container having a base that is responsive to pressure changes within the sealed container, such as a container that can be filled with a liquid product such as juice, pasta sauce, carbonated beverages, etc. In one embodiment, the base of the plastic container has a diaphragm that curves downward from a hinge to a central region. As pressure changes within the sealed container, the central region moves axially. In another embodiment, the diaphragm has an asymmetric flexible wall that includes a first portion with a curved profile and a second portion with a linear profile. In the activated position, for example, the diaphragm may buckle, providing a visual indicator of the base being in the activated position. A base as disclosed herein can have a continuous range of positions between the as-formed position or pre-activation position and the activated position, in accordance with some embodiments.

Another aspect of the present disclosure is directed to a container body having wall sections interspersed axially with ribs of reduced diameter compared to the wall sections. Each rib includes a plurality of protrusions that are distributed circumferentially. For example, the protrusions are a wedge-shaped deviation in the reduced diameter of the rib. Protrusions in adjacent ribs can be arranged in an circumferentially offset pattern, similar to a brick pattern.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

The accompanying drawings, which are incorporated in and constitute a part of the specification, illustrate various embodiments of the present disclosure and together with the summary above and the detailed description of the drawings given below, serve to explain the principles of the present disclosure. The present disclosure will now be described, by way of examples, with reference to the accompanying drawings.

BRIEF DESCRIPTION OF THE DRAWINGS

FIG. 15 is a side view of a rib and protrusion according to detail B of FIG. 1, in accordance with an embodiment of the present disclosure.

FIG. 16 is a front view of a rib and protrusion according to detail C of FIG. 1, in accordance with an embodiment of the present disclosure.

FIG. 17 is a cross-sectional view taken generally along line 17-17 of FIG. 16 and shows the profile of the protrusion, in accordance with an embodiment of the present disclosure.

Figure 1:
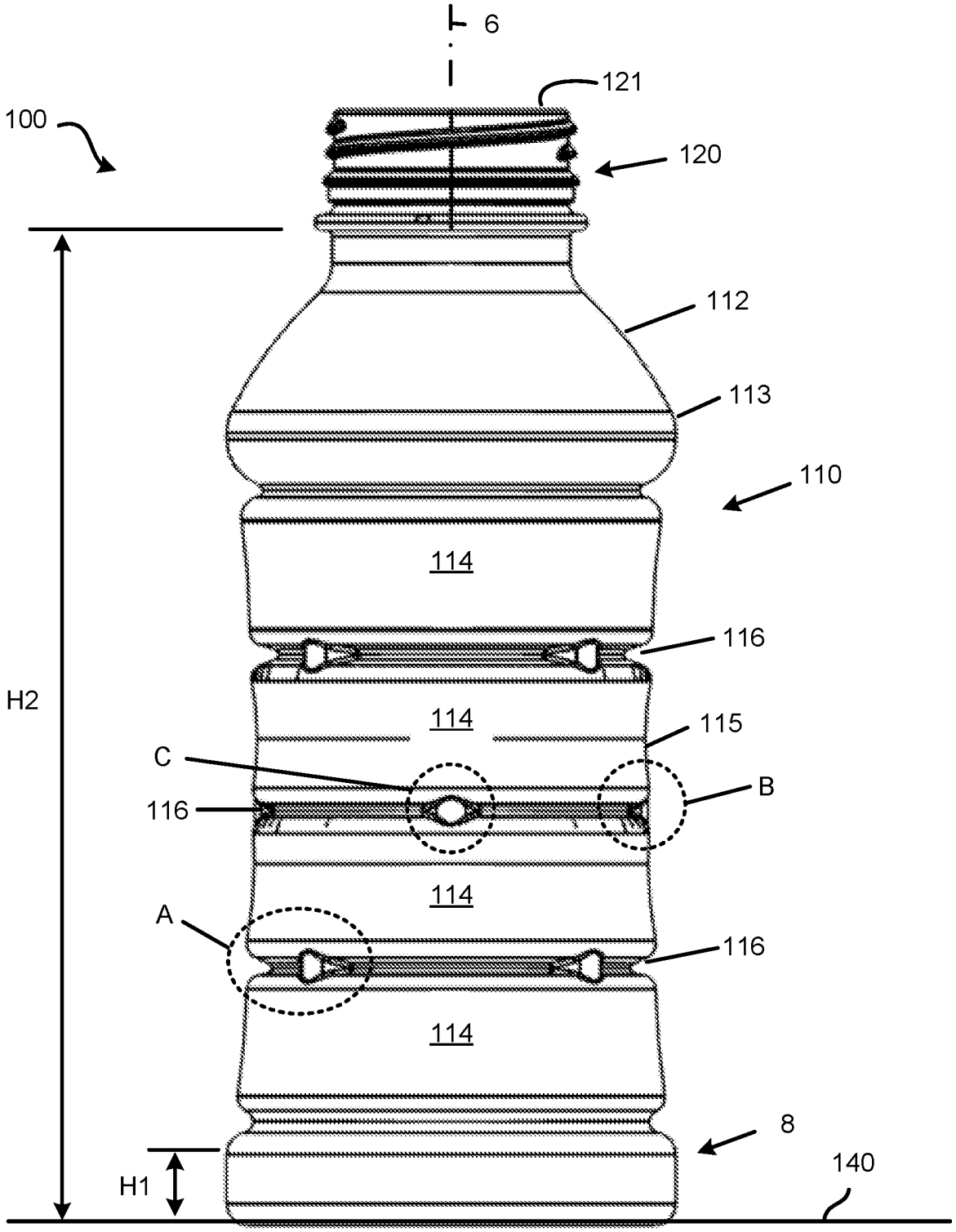
FIG. 1 is an elevational view of a plastic container as molded in an empty state, according to an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a plastic container having a base portion adapted for vacuum absorption, the container comprising a base and a body extending up from the base along a central axis to a finish portion defining a mouth. The base includes an outside wall, a chime connecting the outside wall to an annular contact ring, an inside wall extending upward from the contact ring to a hinge, and a diaphragm connected to the hinge. The diaphragm can move between first and second positions in response to pressure change within the container. The diaphragm includes a central region and a flexible wall having a curved profile in cross section. The flexible wall curves downward and radially inward from the hinge to the central region. In response to pressure changes within the container, such as may occur in a hot-fill process, the diaphragm can move from the first position to the second position, where the central region translates axially upward towards the mouth of the container. In other embodiments, the as-formed shape of the base has the reverse configuration, where the central region moves downward away from the mouth of the container when activated.

In another embodiment, the diaphragm has an asymmetric configuration that includes a central region and a flexible wall surrounding the central region, where the flexible wall includes a first portion having a curved profile between the central region and the hinge, a second portion having a linear profile between the central region and the hinge. Transition portions extend radially between the central region and the hinge and are positioned circumferentially between the first portion and the second portion. In one such embodiment, when the base is in the first position (e.g., a pre-activation position), the central region is oriented perpendicularly to the central axis. When the diaphragm moves to the second position (e.g., an activated position), the central region may be oriented transversely to the central axis, owing to the differences in flexibility between the linear portion and the curved portion of the flexible wall. In one such embodiment, the "buckled" shape of the flexible wall in the second position is a visual indicator that the container has been properly sealed.

A plastic container as disclosed herein can include a variety of container bodies. In one example, the body includes a series of generally annular wall sections that are interspersed axially with radially inward ribs. Each rib includes a plurality of protrusions (e.g., at least 3) that are distributed circumferentially around the rib. The protrusions increase strength of the container and resist vertical crushing or folding at the ribs. In some embodiments, the protrusions are offset circumferentially in adjacent ribs, such as in a brick-like pattern.

The terminology used herein is for the purpose of describing example embodiments and is not intended to be limiting. As used herein, the singular forms "a", "an" and "the" may be intended to include the plural forms as well, unless the context clearly indicates otherwise. The terms used herein for describing the various elements, the arrangements, interconnections and/or relative locations of the various elements of the plastic container are to be understood in relation to the plastic container standing directly upright on a horizontally aligned support surface and in relation to a central vertical axis (longitudinal axis) which at least substantially extends at a right angle relative to the support surface and centrally through the plastic container.

Overview

Existing beverage containers include a one-piece plastic bottle with a champagne base and annular chime. The bottle is configured for containing carbonated beverages and has a base that includes an inner wall that slopes upward and inward from the chime to the center. In one such design, the chime has a thickness to define an integral reinforcing hoop connected to a thickened base portion that extends between the hoop and the center of the base portion. Due to the reinforcing hoop, the base is resistant to inversion, such as due to pressure within the bottle, that extends in a hoop direction. Such design is intended to resist inversion of the base due to internal pressure. The increased thickness of such a design makes the bottle less suitable for accommodating pressure changes within the bottle. For example, in a hot-fill process, the volume reduction associated with cooling the sealed container may rely on features of the sidewall or other features to absorb changes in pressure within the bottle.

Other blow-molded containers use a pushup rod during manufacture to mechanically cause part of the base to invert. For example, the base may feature an S-shaped flexible wall between the chime and the pushup, where pushing the pushup towards the mouth of the bottle causes the S-shape to invert in part and attain an activated shape. Yet other blow-molded containers require "feet" on the base in order to remain stable as pressure changes within the bottle. However, the feet are not desirable for some beverages.

Despite advances in blow-molded containers, it would be desirable to have a plastic container with a circular contact ring and a flexible wall that better responds to pressure changes within the bottle. It would also be desirable to have a flexible wall that does not require the use of a pushup rod or the like to convert the base from the as-formed position to an activated position as a hot beverage within the sealed container cools to room temperature. Therefore, a need exists for advances in plastic blow-molded containers.

The present disclosure addresses these needs and others by providing a blow-molded container having an annular contact ring and a flexible diaphragm that extends downward from an inner wall to a central region, where the diaphragm is responsive to pressure changes within the container without the need for mechanical action. A container in accordance with the present disclosure can be made with PET or other suitable material and configured for use with juice, sauce, or pasteurized liquids, to name a few examples. A container in accordance with the present disclosure further can be configured for a variety of volumes, sidewall configurations, and finish portions. Numerous variations and embodiments will be apparent in light of the present disclosure.

Example Embodiments

Figure 2:
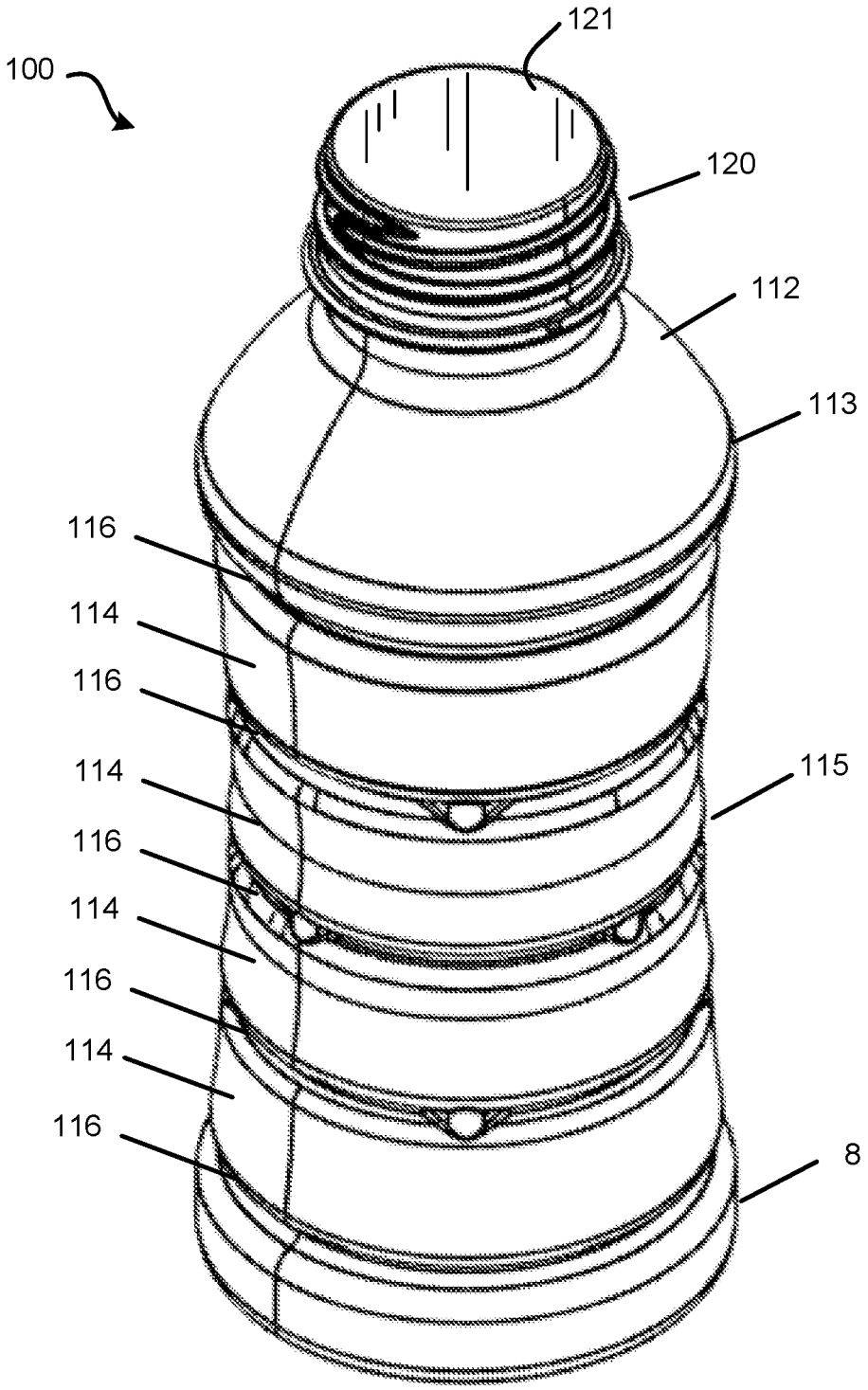
FIG. 2 is a top perspective view of the plastic container of FIG. 1.
Figure 3:
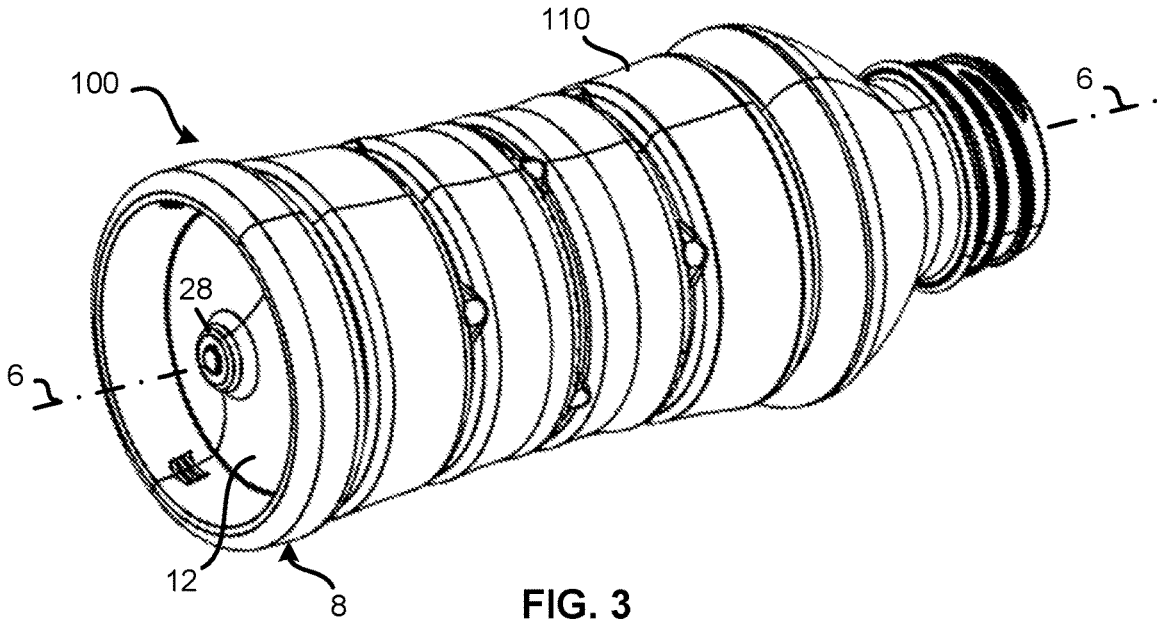
FIG. 3 is a bottom perspective view of a plastic container and shows the base with a flexible diaphragm, in accordance with an embodiment of the present disclosure.
Figure 4:
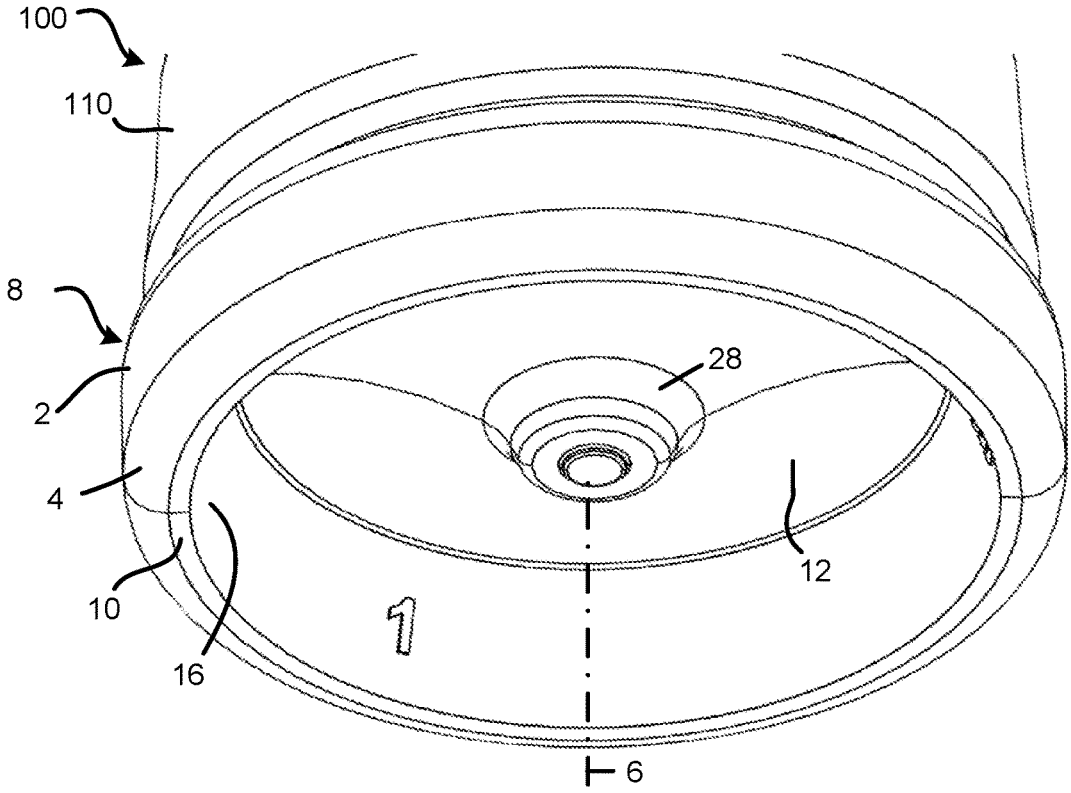
FIG. 4 is a bottom perspective view of the base portion of the plastic container of FIG. 3, in accordance with an embodiment.

FIGS. 1 and 2 show a plastic container 100 in an empty and as-formed configuration, according to an embodiment of the present disclosure. From a top of the container and moving in a downward direction toward a bottom of the container, which is supported on the support surface 140, the container 100 generally includes a neck or finish portion 120, a body 110, and a base 8 that is in contact with the support surface 140. The container 100 extends along a central axis 6 which extends vertically through a center of the container 100 when it is in an upright orientation. The finish portion 120 is located at the top of the container 100 and forms an opening which can facilitate formation of the container in a manner described below in more detail. The finish portion 120 can include threads or other closing feature and may be configured for a screw-on cap, a flip top, a wide mouth 121, a narrow mouth 121, or any other finish, as will be appreciated.

In this example, the container body 110 includes a shoulder region 112 that is integrally formed with and extends downward from the finish portion 120 to an upper body portion 113 increased diameter. In some embodiments, the diameter at the upper body portion 113 is substantially equal to that at the base 8 (e.g., within manufacturing tolerances) so that the container 100 generally rolls in a straight line. The shoulder region 112 merges into and provides a transition between the neck and the body 110 of the container 100. Note that the body 110 also defines a middle region or waist 115 of reduced diameter compared to the upper body portion 113 and compared to the base 8. In this example, the body 110 has a gradual reduction in diameter from the base 8 to the waist 115 and from the upper body portion 113 to the waist 115. The body 110 extends downward from the shoulder region 112 to the base 8 and is formed by a plurality of annular wall sections 114 interspersed with ribs 116. In some embodiments, one or more of the ribs 116 can be segmented. In this example, three of the ribs 116 in the middle portion of the container 100 are segmented; the uppermost rib 116 adjacent the shoulder region 112 and the lowermost rib 116 adjacent the base 8 are not segmented. The body 110 of the container 100, including the wall sections 114 and segmented ribs 116, will be described below in more detail below.

The base 8 is integrally formed with and extends downward from a bottom of the body 110 and is configured to communicate with a support surface 140, such as a table or other flat surface. The base 8 functions to close the bottom portion of the plastic container 100 and, together with the finish portion 120 and the body 110, retain the product within the container 100. The base 8 is generally configured to stabilize and support the container 100 when the container is positioned on the support surface in an upright orientation. From the elevational view of a plastic container 100 as shown in FIG. 1, the base 8 has an outer wall 2 and a chime 14 which are integrally formed with the body 110 of the container 100.

It is understood that the general dimensions of the container 100 can relate to several different factors such as the volume, appearance, stacking strength, and desired physical characteristics of the container, for example. Examples of container volumes include 250 ml (~8.5 oz.), 355 ml. (~12 oz.), 475 ml. (~16 oz.), 600 ml. (~20 oz.), 1 liter, 1.5 liters, and 2 liters. The container 100 can be made of any of a variety of suitable materials, including polyethylene terephthalate (PET), polypropylene (PP), polyurethane, polystyrene, high density polyethylene (HDPE), nylon/polyamide, and other thermoplastic elastomers.

In one embodiment of the container having a volume of about 12 oz., the outer wall 2 of the base has a vertical height H1 of about 0.3-0.5 inch, or about 0.45 inch. The container body has an overall vertical height H2 from 4-7 inches, including 5-6 inches, or about 5.5 inches. In one such embodiment, the container 100 has a vertical height H2 of about 5.8 inches from the contact ring to a base of the finish portion, and an overall height of about 6.6 inches, including the finish portion. Further, the outer wall has a diameter that is from 2-3 inches, including from 2.25-2.75 inches. In one such embodiment, the base has an outer diameter of about 2.6 inches. It is to be appreciated, however, that the diameter of the outer wall relates to desired stability of the container on various support surfaces. Generally, the stability of the container 100 increases as the diameter of the base increases. Although the profile of the body 110 is shown as being generally vertical, it is to be understood that the body 110 could be formed such that the profile is sloped or angled with respect to the central axis 6 such that the top, middle, and bottom portions of the outer wall 2 may have different diameters. Further, the outer wall 2 could be formed such that the profile of the body 110 can be curved relative to the central axis 6 to provide a convex or concave profile along the body 110. Numerous variations and embodiments will be apparent in light of the present disclosure.

As shown in FIGS. 3-6, the container 100 extends along a central axis 6 to a base 8 that includes an outer wall 2 and chime 4. The chime 4 has a rounded profile and connects the outer wall 2 to the contact ring 10, which generally extends perpendicular to the central axis 6 and provides a substantially planar and annular surface for the container 100. Moving in a direction radially inward from the outer wall 2, the base 8 further includes an inner wall 16 extending upward from an inner circumference of the contact ring 10 to a hinge 24. A movable diaphragm 12 connects to the hinge 24 and closes the base 8.

Figure 5:
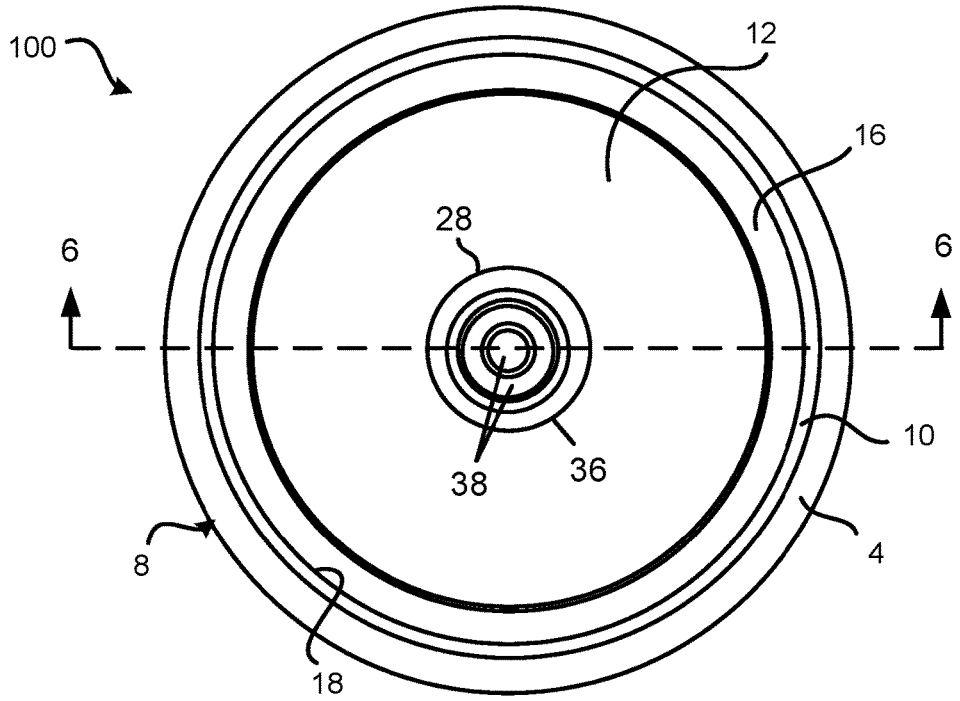
FIG. 5 is a bottom view of the plastic container of FIG. 3.
Figure 6:
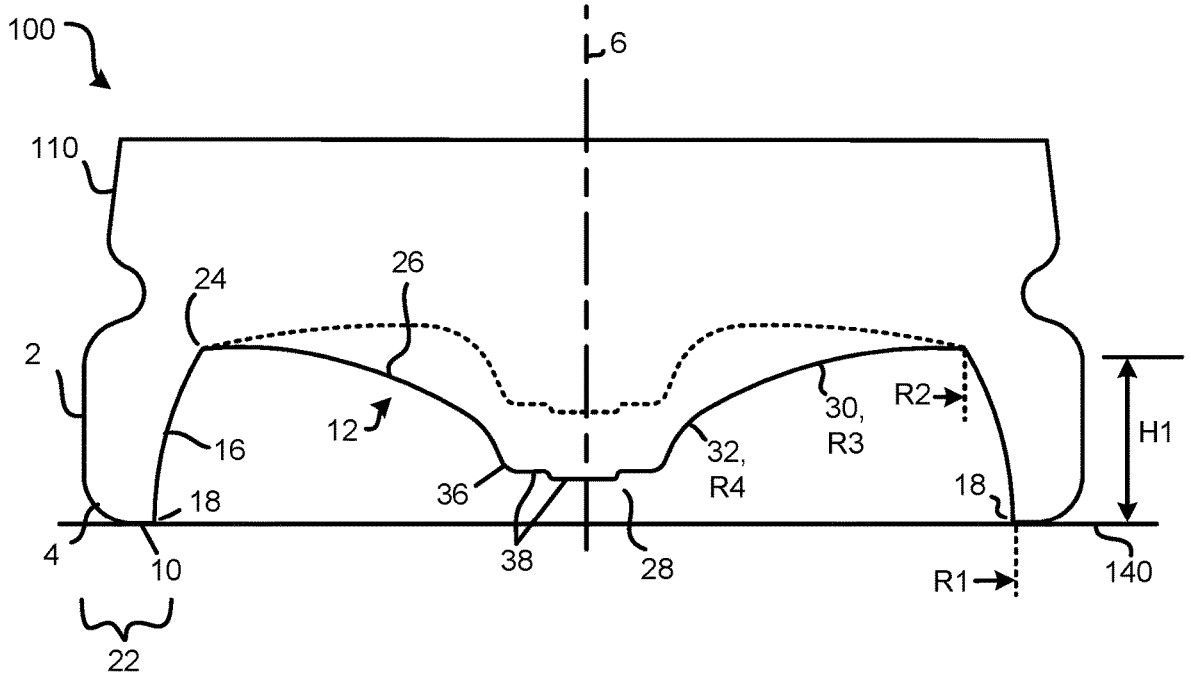
FIG. 6 is a cross-sectional view of the base of the plastic container of FIG. 3 taken generally along line 6-6 of FIG. 5, in accordance with an embodiment.
Figure 7:
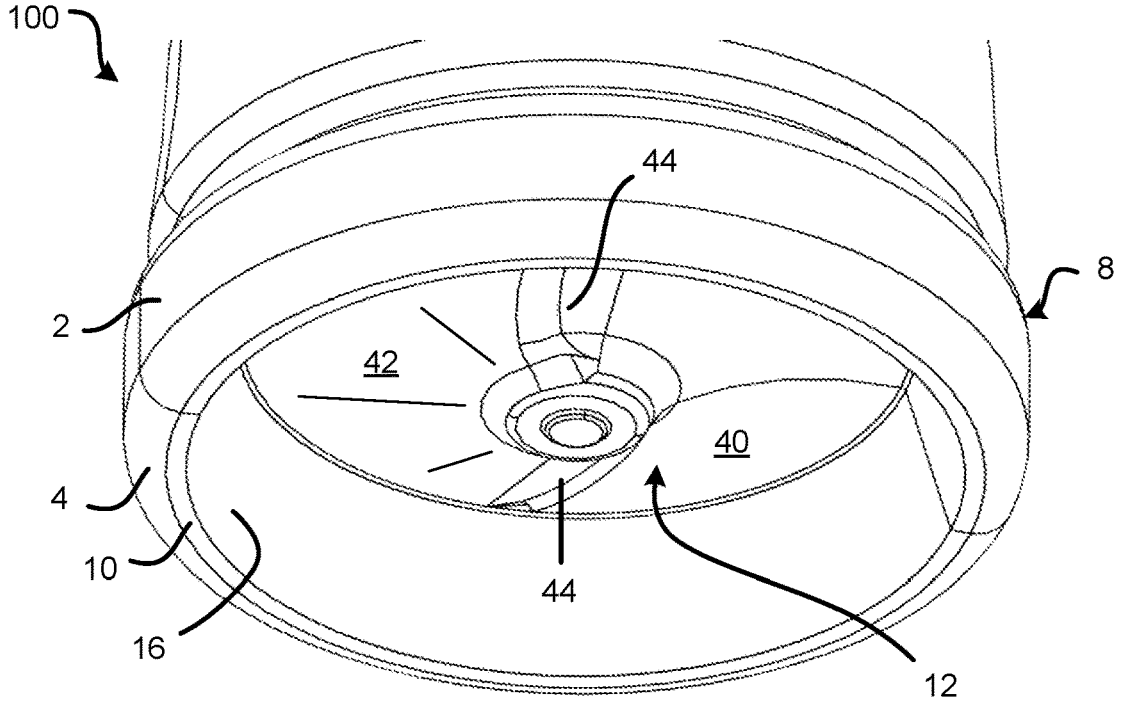
FIG. 7 is a bottom perspective view of a base portion of a plastic container, where the base has an asymmetric flexible wall portion, in accordance with another embodiment of the present disclosure.
Figure 8:
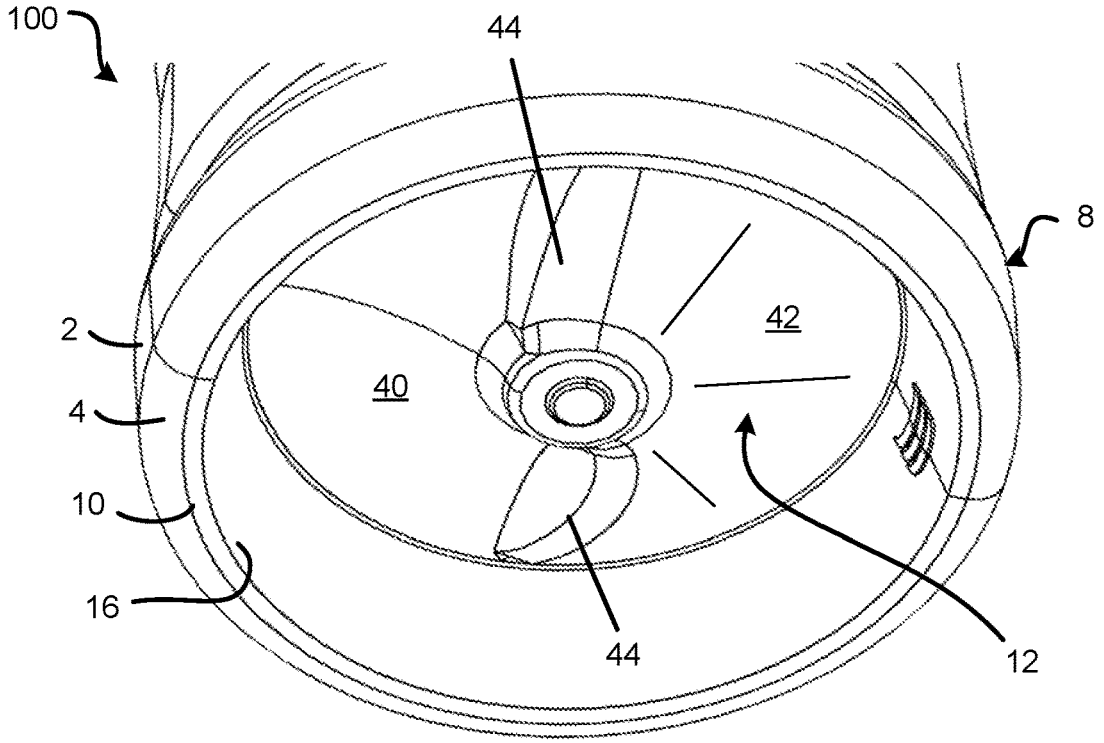
FIG. 8 is another bottom perspective view of the base portion of the container of FIG. 7.

FIG. 5 is a bottom view of the base 8 of the container 100 illustrated in FIG. 1. FIG. 6 illustrates a cross sectional view of a lower portion of the container 100 including a bottom section of the body 110 and the base 8 as viewed along section line 6-6 of FIG. 5. Since the base 8 of the container 100 is rotationally symmetric in this embodiment, excluding markings or labels, the cross-sectional view of the base 8 would be the same regardless of the rotational orientation of the container about the central axis 6. In other words, the profile of the base 8 on the right side of the central axis 6, as viewed in FIG. 6, is reflected on the left side of the central axis 6. In the following description, the various elements of the base 8 may be described using terms in relation to the central axis 6 or relative to the support surface 140 on which the container 100 is positioned. Since the profile of the base 8 is the same on opposite sides of the central axis 6, for the sake of simplicity, only one side of the profile may be described in detail; however, in this embodiment it is to be understood that the description of one side of the profile also applies to the opposite side of the profile.

The base 8 includes a radially outer wall 2 that is can be formed substantially as a right circular cylinder, meaning that the outer wall has a profile that is flat and extends vertically in a direction generally parallel to the central axis 6 of the container 100. The bottom of the outer wall 2 merges into the chime 4 and the contact ring 10. the contact ring 10 being a portion of the base that contacts the support surface 140 upon which the container is supported. The contact ring 10 can be considered as the bottom end of the container, e.g., the bottom surface of the container 100 that is axially furthest from the mouth 121 of the container. In some embodiments, the contact ring 10 may be an annular, flat surface that extends radially with respect to the central vertical axis 6. In other embodiments, the contact ring 10 may be a circle of contact that generally circumscribes the base 8.

The chime 4 of the base has a curved or arcuate profile and is integrally formed between the bottom of the outer wall 2 and the contact ring 10. From the contact ring 10, the base 8 comprises a radially inner wall 16 that extends upward toward the top of the container 100 to a hinge 24 between the radially inner wall 16 and the diaphragm 12. The inner wall 16 forms a transition between the contact ring 10 and an outer edge of the diaphragm 12. The inner wall 16 is shown in FIG. 6 as having a profile that is curved or concave. This curvature or concavity contributes to the substantial strength of the inner wall 16. The strength of inner wall 16 can also be attributed to combination of its vertical depth, and differences between a first radius R1 at a lower edge 18 of the inner wall 16 and a second radius R2 at the hinge 24 or upper edge of the inner wall 16. In this example, the inner wall 16 has a lower edge with a first radius R1 that is greater than the second radius R2 at the upper edge of the inner wall 16. Although the curved profile of the inner wall 16 is generally stronger, it is to be appreciated that the inner wall can be formed to have an at least substantially linear profile, such as a frustoconical shape. Together the outer wall 2, chime 4, contact ring 10, and the inner wall 16 define a continuous annular heel 22 that circumscribes the base 8. Although the base 8 can be formed such that the heel 22 is segmented circumferentially around the base 8, it is preferable for the heel 22 to extend continuously around the base 8 to provide a continuous ring of contact with the support surface 140.

The top edge of the inner wall 16, or hinge 24, merges into a radially outer perimeter of a movable diaphragm 12. The point in the cross-sectional profile of the base at which the inner wall 16 and the diaphragm 12 merge can be referred to as the hinge 24 because it is at this point that the diaphragm 12 flexes or moves relative to the inner wall 16. The diaphragm 12 includes a flexible wall 26 and a central region 28. The flexible wall 26 is a generally curved surface that slopes downward and inward from the hinge 24 toward the central axis 6. As such the flexible wall 26 generally protrudes axially away (e.g., downward) from an interior of the container 100. The flexible wall 26 is formed by a first annular portion 30 and a second annular portion 32 that merge into each other and form a transition 44 therebetween. The radially outer perimeter of the first annular portion 30 forms the outer perimeter of the diaphragm 12 and merges with the top edge of the inner wall 16 via the hinge 24. A radially inner perimeter of the second annular portion 32 merges with an outer perimeter of the central region 38. The first annular portion 30 has a first radius of curvature R3 and the second annular portion 32 has a second radius of curvature R4 that are different than each other, such as illustrated in FIG. 6. In this example, the first radius of curvature R3 of the first annular portion 30 is greater than the second radius of curvature R4 of the second annular portion 32. In one example, the first radius of curvature R3 is from 1.1-1.2 inches, or about 1.18 inches, and the second radius of curvature R4 is from 0.15 to 0.25 inch, such as about 0.2 inch.

As shown in FIG. 6, the diaphragm 12 can move in the axial direction in response to pressure changes in the container 100. The diaphragm 12 is configured to flex or move between a first position and a second position. In one embodiment, the first position is referred to as a pre-activation position or as-formed position and the second position is referred to as a post activation position or activated position. In the cross-sectional view of the base of FIG. 6, the pre-activation position of the diaphragm 12 is illustrated by means of a solid line, whereas the post activation position of the diaphragm 12 is shown by means of a dashed line. The pre-activation position of the diaphragm 12 is the position of the diaphragm at the conclusion of the container forming process, or the "as formed condition" of the base 8. The diaphragm in the post activation position is to be considered as the activated condition of the base 8 after the container 100 responds to pressure changes inside the sealed container 100. For example, the as-formed position and the activated position of the diaphragm 12 generally relate to the process of hot filling the containers as briefly described above.

In one embodiment, the diaphragm 12 in the pre-activation position or the "as formed" position of the base 8 is located axially closer to the axial position of a plane of the contact ring 10 than in the activated position. Subsequent to hot filling and sealing of the container, as pressure decreases within the sealed container 100 and causes the diaphragm 12 to move axially to the activated position (e.g., as shown by the dashed line of FIG. 6). The diaphragm 12 generally exhibits a greater amount of axial movement towards the central region 28 and a lesser amount of axial movement towards the hinge 24.

The diaphragm 12 can be designed such that the transition 44 between the first and second annular portions 30, 32 flexes during transition to the activated position. In one such embodiment, second radius of curvature R4 of the second annular portion 32 remains the same or substantially the same (e.g., ±0.02 inch or ±0.01 inch) when the diaphragm 12 moves from the pre-activation position to the post-activation position. The diaphragm 12 can be further designed such that orientation of the second annular portion 32 relative to the central region 28 remains the same as the diaphragm 12 moves between the pre-activation and post-activation positions. The base 8 designed according to embodiments discussed above enables the container 100 to better accommodate changes of internal pressure and avoids the need to mechanically push the diaphragm 12 into the post activation position. Additionally, the diaphragm 12 of this design maintains its activated condition or shape even when internal pressure is temporarily raised within the container, such as caused by ordinary events during handling and shipping. Advantageously, the diaphragm 12 can be used for both hot-fill applications, cold-fill applications, and for liquids requiring pasteurization or heating after the container is sealed.

Further, containers comprising the base 8 designed in the manner described above are beneficial for use with liquids requiring pasteurization processes in which during the heating process, as pressure increases inside the sealed container, causing the diaphragm 12 to move from a first position (e.g., an as-formed position) downward to a second position (e.g., activated position). Subsequently upon cooling, the diaphragm 12 can move upward partially or completely to the first position. In one such embodiment, the first or as-formed position of the diaphragm is represented by the broken line of FIG. 6 and the second or activated position of the diaphragm is represented by the solid line of FIG. 6 (e.g., the reverse of the first and second positions for a hot-fill beverage container).

In some embodiments, characteristics of the diaphragm 12 can be influenced or enhanced by the relative material thicknesses of the first and second annular portions 30, 32 of the diaphragm 12. For example, the first annular portion can have a greater wall thickness compared to the second annular portion or vice versa. Additionally, the diaphragm 12 can be formed to have a wall thickness that is less than a wall thickness of the container body 110. In one such embodiment, the wall thickness of the container body 110 is maximized while the wall thickness of the diaphragm 12 is minimized. Numerous variations and embodiments will be apparent in light of the present disclosure.

In some embodiments, to facilitate axial movement of the diaphragm 12, the wall thickness of the first annular portion 30 can be less than the wall thickness of the second annular portion 32 with the wall thickness increasing in the transition 44 between the first and second annular portions 30, 32. Due to the greater relative wall thickness, the profile of the second annular portion 32 remains at least substantially the same in both of the pre- and post-activation positions of the diaphragm 12. As such it is to be understood that in some embodiments flexing of the flexible wall 26 occurs predominantly along the first annular portion 30.

As shown in the cross-sectional profile of the base of FIG. 6, the central region 28 has the outer perimeter 36 and a pair of axially offset planar surfaces 38 that are coaxially arranged with each other. The outer perimeter of the central region 28 is rounded upward and merges with the inner perimeter of the second annular portion 32, while the pair of planar surfaces 38 are oriented generally perpendicular to the central axis 6.

With the cross-sectional profile of the diaphragm illustrated in FIG. 6, the central region 28 projects in an axial direction away (e.g., downward) from an interior of the container 100. Advantageously, the central region 28 does not project axially beyond a plane defined by the contact ring 10, absent an abnormal condition. As shown in FIG. 6, in the as-formed condition of the base 8, an axial position of the central region 28 is relatively close to that of the contact ring 10; however, it is recognized that a difference in axial position exists between the central region 28 and the contact ring 10. In some embodiments, when the diaphragm 12 is in the pre-activation position, the difference in axial position between the central region 28 of the diaphragm 12 and the contact ring 10 is from 0.10 inch and 0.20 inch, including between 0.125 inch and 0.150 inch. In one embodiment, the difference in axial position between the central region 28 of the diaphragm 12 and the contact ring 10 is about 0.14 inch. In such an embodiment, the central region does not extend axially beyond the contact ring, absent an extraordinary pressure condition within the container, for example. Accordingly, a container 100 having a base 8 as disclosed herein includes a circular contact ring 10 and avoids the problem of the container 100 tipping over in a pressurized condition when the base 8 of the container 100 is set upon a support surface 140. Following activation of the diaphragm 12, i.e., when the diaphragm is in the post-activation position, the axial distance between the central region 28 of the diaphragm 12 and the contact ring 10 is from 0.245 inch to 0.345 inch, including from 0.270 inch to 0.320 inch. In one embodiment, when the diaphragm 12 is in the post-activation position, the axial distance between the central region 28 of the diaphragm 12 and the contact ring 10 is about 0.295 inch. Based on the above, the axial travel of the central region 28, i.e., the axial distance the central region 28 moves when the diaphragm 12 changes from the pre-activation position to the post-activation position is from 0.125 inch to 0.20 inch, including from 0.140 inch and 0.170 inch, and from 0.150-0.160 inch.

FIGS. 7-13 illustrate a base 8 of a container 100 according to another embodiment of the present disclosure. As this embodiment includes some features found in embodiments discussed above, this discussion will focus on features not discussed above. The base 8 includes the outer wall 2, chime 4, and contact ring 10 as described above with reference to FIGS. 1-6. However, as shown in the bottom perspective views of FIGS. 7 and 8, for example, the diaphragm 12 is asymmetric and comprises a curved portion and a linear portion, as described below in greater detail.

Figure 9:
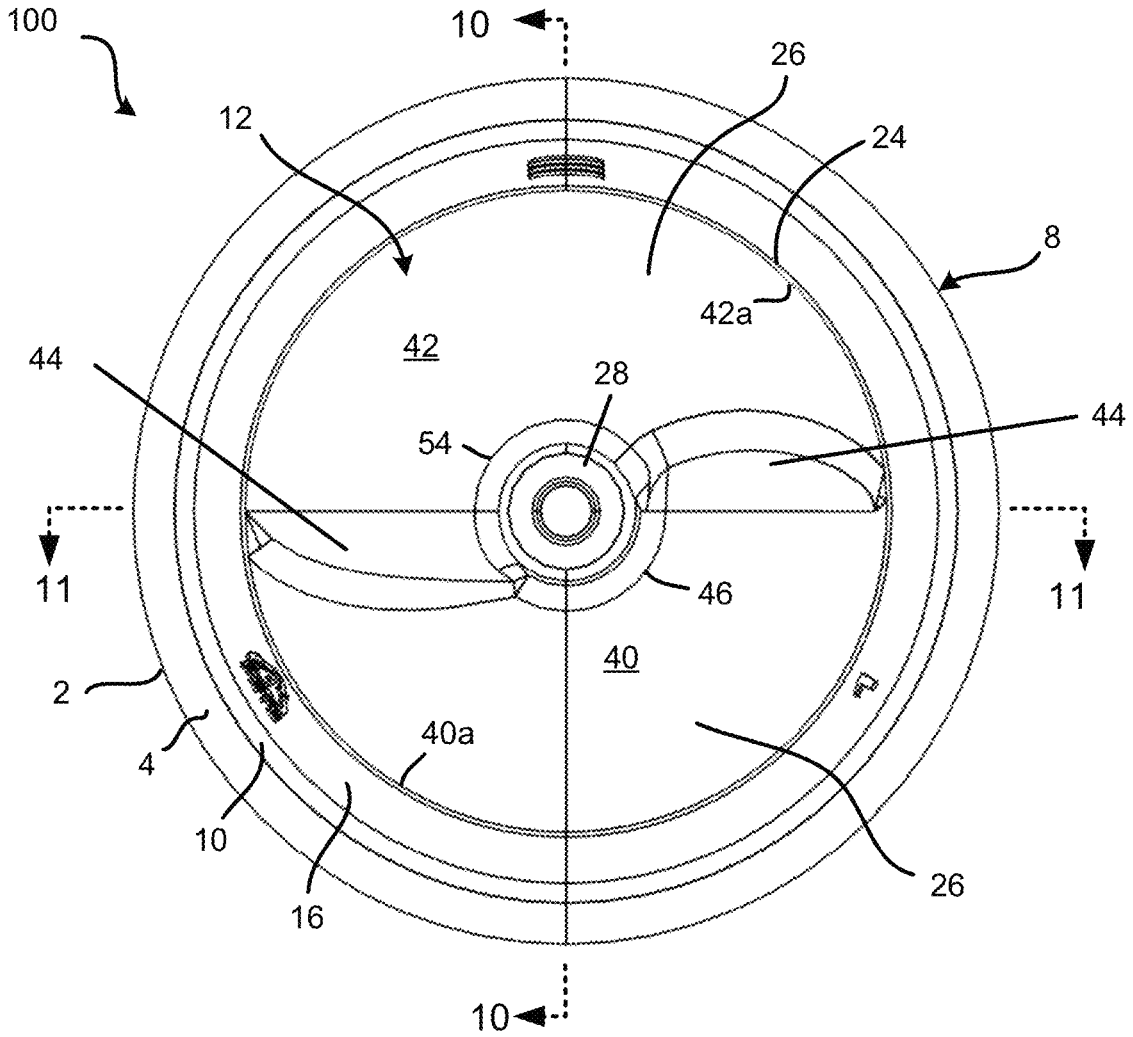
FIG. 9 is a bottom view of the plastic container of FIGS. 7 and 8.

FIG. 9 is a bottom view of a base 8 of a container 100, in accordance with another embodiment of the present disclosure.

The diaphragm 12 includes a flexible wall 26 around a central region 28, where the flexible wall 26 includes a curved portion 40 and a linear portion 42. The curved portion 40 and the linear portion 42 merge into each other or are otherwise connected by transitions 44 that extend generally radially outward from the central region 28. These transitions 44 are shown in FIG. 9 as extending generally radially outward in a curved manner from the central region to the upper edge of the inner wall. Viewing the diaphragm from the bottom, such as in FIG. 9, the transitions 44 separate the flexible wall 26 generally into two portions, namely the curved portion 40 and the linear portion 42. It is to be understood that the curved portion 40 and the linear portion 42 of the diaphragm 12 refer specifically to their profiles when viewed in cross section. In 3D space, the linear portion 42 can be described, for example, as having a frustoconical geometry and the curved portion 40 can be described as following a toroidal geometry, where the transitions 44 extend between and join the frustoconical and toroidal portions. The curved portion 40 extends circumferentially around part of the central portion. In some embodiments, the curved portion spans about 180° around the central axis and connects to transitions 44 adjacent the hinge at points that are positioned 180° from one another, such as shown in FIG. 9. The linear portion 42 also extends circumferentially part way around the central region 28 (e.g., about 180°). The transitions 44 connect the linear portion 42 and the curved portion 40. The radially outer perimeter 40*a* of the curved portion 40 and the radially outer perimeter 42*a* of the linear portion 42 together define the radially outer perimeter of the diaphragm 12, which connects to the hinge 24 at the of the inner wall 16.

In some embodiments, the curved shape of the transitions 44 and circular boundary of the hinge 24 results in the curved portion and the planar portion each approximating a teardrop shape oriented around the central portion, where a radially larger region or head of one portion abuts a radially smaller region or tail of the other and vice versa, similar to a yin-yang pattern. In other embodiments, the transitions can extend radially from the central region to the hinge along a generally linear path where the curved portion and the planar portion approximates an annular sector of about 180° around the central region.

Figure 10:
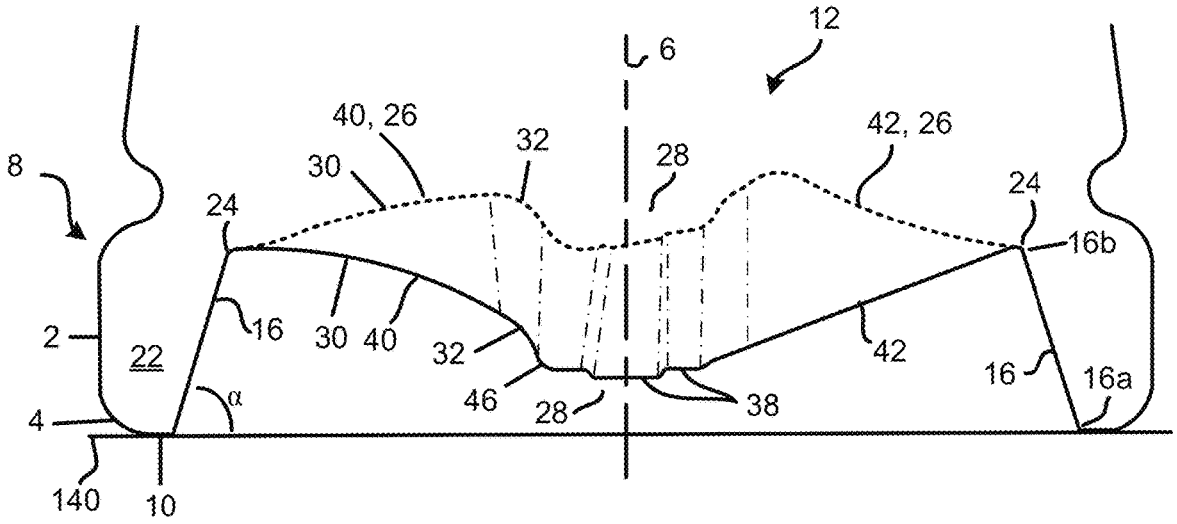
FIG. 10 is a cross-sectional view taken generally along line 10-10 of FIG. 9 and shows the as-formed shape in solid line and an activated shape in broken line, in accordance with an embodiment.
Figure 11:
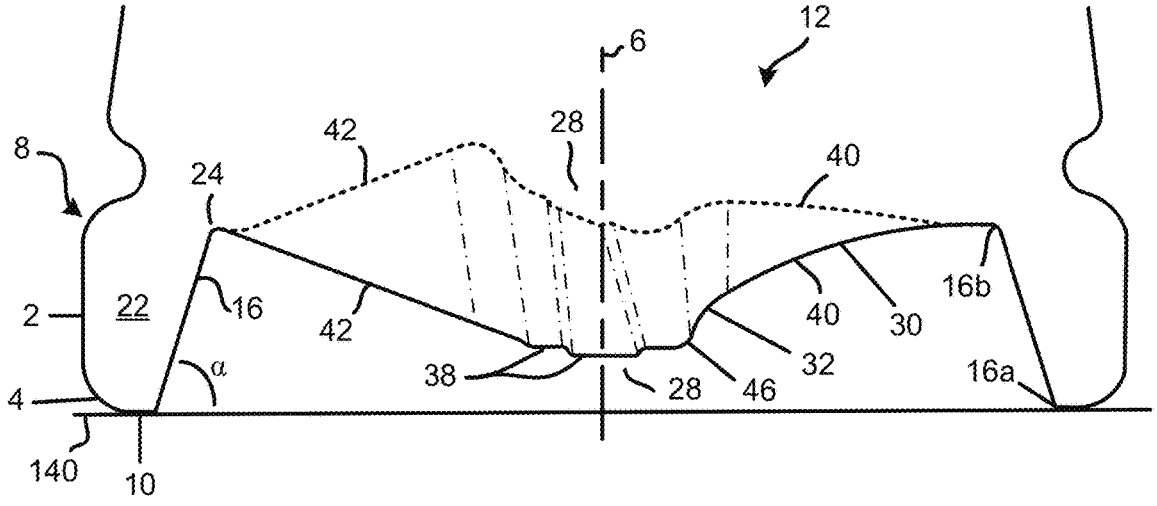
FIG. 11 is a cross-sectional view taken generally along line 11-11 of FIG. 9 and shows the as-formed shape in solid line and an activated shape in broken line, in accordance with an embodiment.

FIGS. 10 and 11 show cross-sectional views of the base 8 as taken along section lines 10-10 and 11-11, respectively, of FIG. 9, where section lines 10-10 and 11-11 are perpendicular to each other. The curved portion 40 of the flexible wall 26 is shown on the left side of the central axis 6 in FIG. 10 and is shown on the right side of the central axis 6 in FIG. 11. The linear portion 42 of the flexible wall 26 is shown on the right side of the central axis 6 in FIG. 10 and on the left side of the central vertical axis in FIG. 11.

As shown in FIG. 10, the base 8 comprises a radially inner wall 16 that extends upward from the contact ring 10 to the hinge 24 at the outer periphery of the diaphragm 12. In some embodiments, the inner wall 16 extends upward at an angle $\alpha$ from 60-85°, including 70-75°, or about 72° with respect to the horizontal (e.g., support surface 140). The inner wall 16 can be formed to have a cross-sectional profile that is substantially linear from the contact ring 10 to the hinge 24. In this manner the inner wall 16 can be in the form of a right frustrum that is concentric with the central axis 6 and have a lower edge 16*a* defining a circle having a radius that is greater than the radius of a circle defined by the hinge 24 or upper edge 16*b* of the inner wall 16. For example, the inner wall 16 is formed such that the circles defined by the hinge 24 and by the joint with the contact ring 10 are concentric with the central axis 6. It is to be appreciated, however, that all or part of the inner wall 16 can be formed to have a curved profile. For example, part of the inner wall 16 (e.g., a majority portion) has a linear profile between the contact ring 10 and the hinge 24 with the remainder of the inner wall 16 comprising one or more portions of a curved profile. In combination, the outer wall 2, chime 4, contact ring 10, and inner wall 16 define a continuous annular heel 22 that circumscribes the diaphragm 12. In some embodiments, the base 8 can be formed such that the heel 22 is segmented circumferentially, however, it is generally preferable for the heel 22 to extend continuously around the base 8 to provide a continuous, annular contact ring 10 configured to contact a planar support surface 140 when the container 100 is oriented in an upright position on the support surface 140.

The top edge of the inner wall 16, or hinge 24, merges into a radially outer perimeter of a movable diaphragm 12. The point in the cross-sectional profile of the base 8 at which the inner wall 16 and the diaphragm 12 merge can be referred to as a hinge 24 because at this point the diaphragm 12 flexes or moves relative to the inner wall 16. As shown in the cross-sectional views of FIGS. 10 and 11, the diaphragm 12 can generally move in the axial direction with a greater amount of axial movement being towards the central region 28 of the diaphragm 12 and a lesser amount of axial movement adjacent the hinge 24.

The diaphragm 12 in the first or pre-activation position is located axially closer to the contact ring 10 or the bottom end of the container 100 such that the central region 28 is the portion of the diaphragm 12 that has an axial position that is closest to that of the contact ring 10 (e.g., lowest point of diaphragm 12 in the pre-activation position). Similar to embodiments discussed above, the difference in axial position between the central region 28 and the contact ring 10 in the pre-activation position is from 0.10 to 0.20 inch, including from 0.125 to 0.175 inch, from 0.15 to 0.17 inch, or about 0.16 inch. Subsequent to hot filling and sealing of the container 100, pressure inside the sealed container decreases and causes the diaphragm 12 to move generally along the central axis 6 into the container 100 to the activated position, such as shown by the dashed line of FIGS. 10, 11, in which the central region 28 has an axial position that is approximately the same as or above the hinge 24 (e.g., further into the container 100). As such, in the second or post-activation position, the lowest point of the diaphragm 12 may be adjacent the hinge 24 or along part of the central region 28.

As viewed in cross-section, the flexible wall 26 includes a curved portion 40 and a linear portion 42 each of which extends radially inward and downward from the hinge 24 to the central region 28 when the base 8 is in the pre-activation position. As such, the flexible wall 26 generally protrudes axially away (e.g., downward) from an interior of the container 100 with the central region 28 being the furthest away from the interior of container 100 when the base 8 is in the pre-activation position.

In the first or pre-activation position, the curved portion 40 curves radially inward and downward from the hinge 24 to the central region 28 such that the curved portion 40 is concave with respect to the bottom of the container 100. The radially inner perimeter 46 of the curved portion 40 merges with an outer perimeter of the central region 28. When viewed in cross section with the diaphragm 12 in the pre-activation position, the axial position of the radially inner perimeter 46 of the curved portion 40 is closer to the axial position of the contact ring 10 than is the hinge 24.

When viewed in cross section the linear portion 42 extends radially inward and downward along a substantially linear path from the hinge 24 to the central region 28. The radially inner perimeter 54 of the linear portion 42 merges with the outer perimeter of the central region 28.

When viewed in cross section with the diaphragm 12 in the pre-activation position, the axial position of the inner perimeter of the linear portion 42 is closer to the axial position of the contact surface than the hinge 24. For some embodiments, it is to be understood that it is the cross-sectional profile of the linear portion 42 that is straight or linear and the linear portion 42 extends circumferentially part way around the central portion or central region 28 to define part of a frustocone.

As shown in the cross-sectional profile of the base in FIGS. 10 and 11, for example, the central region 28 has the outer perimeter and a pair of axially offset planar surfaces 38. The outer perimeter of the central region 28 is rounded upward and merges with the inner perimeters of the curved portion 40 and linear portion 42, while the pair of axially offset planar surfaces 38 are arranged concentrically with the central axis 6. When viewed in cross section with the diaphragm in the pre-activation position, the central region 28 is generally horizontally aligned, i.e., the central region 28 extends perpendicular to the central axis 6.

The diaphragm 12 is configured to flex or move between at least two positions, namely a first or pre-activation position and a second or post-activation position. In the cross-sectional views of the base 8 of FIGS. 10 and 11, the first or pre-activation position of the diaphragm 12 is illustrated by means of solid line, whereas the second or post-activation position of the diaphragm 12 is shown by means of a dashed line. The first or pre-activation position of the diaphragm 12 can be its position at the conclusion of the container forming process, also referred to generally as the "as-formed position" of the base 8, in accordance with some embodiments. The diaphragm 12 in the post-activation position may be referred to as the second or "activated position" of the base 8 that is attained after the base 8 responds to pressure changes within the sealed container 100. The as-formed and activated positions of the base 8 generally relate to the process of hot filling the container, as briefly described above.

Similar to embodiments discussed above, the curved portion 40 includes first and second annular portions 30, 32 having different radii as illustrated in FIGS. 10, 11. In the pre-activation position, the first annular portion 30 curves downward from the hinge 24 to the central region 28. In the post-activation position, the first annular portion 30 arches slightly upward to the second annular portion 32, which then curves downward to the central region 28.

The linear portion 42 slopes downward to the central region 28 along a linear path when the base 8 is in the pre-activation position. In the post-activation position, the linear portion 42 curves slightly upward with a convex curvature relative to the support surface 140, then arcs downward to the central region 28.

Note in the example of FIGS. 10-11 that planar surfaces 38 of the central region 28 extend perpendicularly to the central axis 6 when the base 8 is in the pre-activation position and angle upward toward the linear portion 42 when the base 8 is in the post-activation position. In some embodiments, the central region 28 has an angle of 5-30° with respect to a horizontal support surface 140, depending on the location of the section and the particular position of the base 8 in the activated position, among other factors. For example, FIG. 10, the central region is angled upward at about 10° and is angled upward at about 22° in FIG. 11.

Referring to the cross-sectional profiles of the diaphragm 12 illustrated in FIGS. 10 and 11, the central region 28 projects in an axial direction away from an interior of the container 100 (e.g., downward toward the bottom of the container) when the diaphragm 12 is in the as-formed position. In the activated position, the central region 28 continues to project axially away (e.g., downward) from the interior of the container 100 and remains closer to the axial position of the contact ring 10 relative to at least some of the curved portion 40 and the linear portion 42 (e.g., the radially inner portions of the curved portion 40 and linear portion 42). In the examples of FIGS. 10 and 11, note that the lowest axial position of the central region 28 is about even with the hinge 24 when the base 8 is in the activated position, where surfaces of the flexible wall 26 extend upward to a peak and then downward to the central region 28.

A desirable aspect is that the central region 28 does not project axially beyond a plane defined by the contact ring 10. As shown in FIGS. 10 and 11, in the "as formed" condition of the base, the central region 28 is located axially adjacent the contact ring 10 however it is recognized that there is a vertical gap or axial distance between the axial position of the central region 28 and that of the contact ring 10. In this example, when the diaphragm 12 is in the pre-activation position (shown as a solid line), the axial distance between the central region 28, i.e., the lowest point of the diaphragm 12, and the contact ring 10 is from 0.10 inch and 0.20 inch, including from 0.14 to 0.18 inch, from 0.15 to 0.17 inch, and about 0.16 inch. At such a distance, the central region 28 is prevented from extending beyond the plane of the contact ring 10, which could cause the container 100 to tip over when the container is set upon a support surface 140. Following activation of the diaphragm 12, the axial distance between the central region 28 and the contact ring 10 may be between 0.4 inch and 0.5 inch, including from 0.43 inch to 0.50 inch and about 0.46 inch. In some embodiments, the axial travel of the central region 28, i.e., the axial distance the central region 28 moves when the diaphragm 12 changes from the pre-activation position to the post-activation position, is from 0.25 inch and 0.35 inch, including from 0.29 inch to 0.32 inch, and about 0.31 inch.

With the asymmetric design of the diaphragm 12 that includes both a curved portion 40 and a linear portion 42 arranged on opposite sides of the diaphragm 12, the structural properties of the base 8 differ from those of embodiments having a diaphragm 12 with only a curved cross-sectional profile. In the cross-sectional views of the base 8 in the post-activated position shown in FIGS. 10 and 11, for example, the inner perimeter of the linear portion 42 is located axially higher than the inner perimeter of the curved portion 40. Dash-dot lines in FIGS. 10-11 correlate portions of the diaphragm 12 between the pre-activation position and the post-activation position. For example, due to its curved profile, the curved portion 40 may be structurally more flexible than the linear portion 42 in response to displacement forces applied thereon in the axially upward direction. For example, after hot filling and sealing the container, pressure within the sealed container decreases as the liquid cools, resulting in a vacuum that urges the diaphragm 12 to move upward generally along the central axis 6. With vacuum forces or other upward forces applied to the diaphragm 12, the curved portion 40 may start to bend and/or move axially upward before movement of linear portion 42 begins. This difference is believed to be due to the stiffness and structural support provided by a linear path of material between the central region 28 and the hinge 24. In contrast, the curved portion 40 may bend as the central region 28 starts to move axially into the container 100, initially absorbing the distance required for the linear portion 42 to remain linear as it extends perpendicular to the central axis 6, and subsequently transferring stored energy associated with the increased bend to deflect the linear portion 42 upward.

Figure 12:
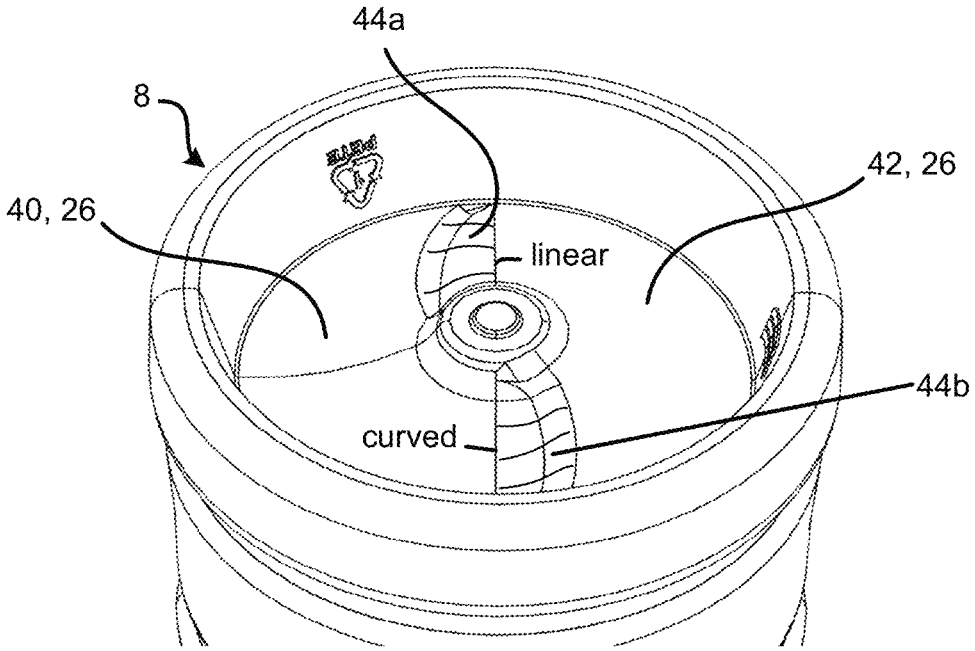
FIG. 12 is a perspective view showing the base of the container of FIG. 8, in accordance with an embodiment of the present disclosure.

Referring now to FIG. 12, a bottom perspective view illustrates the base 8 of the container 100 in an inverted orientation and with the base 8 in a pre-activation position, in accordance with an embodiment of the present disclosure. On the right side of FIG. 12 is the linear portion 42 and the curved portion 40 is in the left side of FIG. 12. Transitions 44 arranged about 180° apart connect the linear portion 42 and curved portion 40. Note that a first transition 44*a* toward the upper part of FIG. 12 exhibits more of a convex profile or roll down from the linear portion 42 to the curved portion 40. A second transition 44*b* opposite the first transition 44*a* exhibits more of a concave profile or scoop up from the curved portion 40 to the linear portion 42. Lines that appear straight in FIG. 12 are labeled as linear or curved to identify the profile along those lines.

Figure 13:
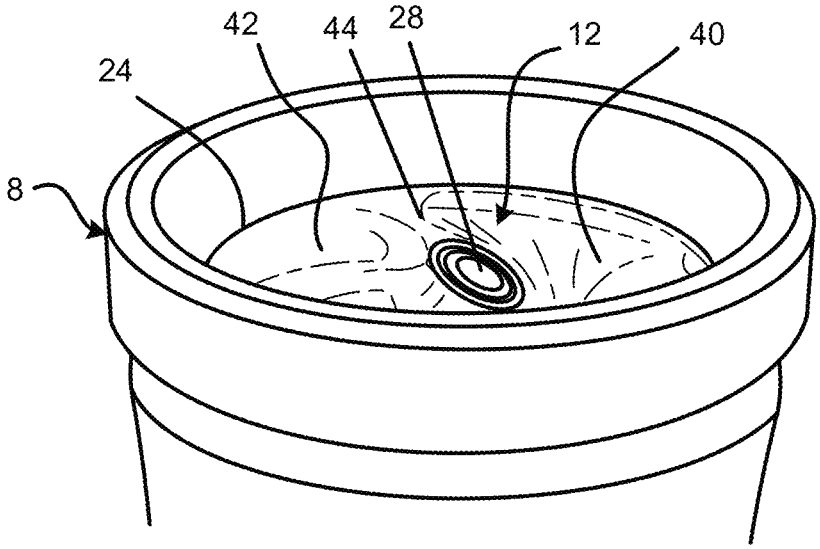
FIG. 13 is a perspective view showing the base of the container of FIG. 12 in an activated position, in accordance with an embodiment of the present disclosure.

Referring now to FIG. 13, a bottom perspective view illustrates the base 8 of the container 100 in an inverted orientation and with the base 8 in a post-activation position, in accordance with an embodiment of the present disclosure. In this example, the linear portion 42 in on the left side of FIG. 13 and the curved portion 40 is on the right side of FIG. 13, consistent with the cross-sectional view of FIG. 11. When the base 8 transitions from the pre-activation position to the post-activation position, the stiffness of the linear portion 42 may cause the diaphragm 12 to buckle such that the central region 28 is tilted with respect to the central axis 6, such as shown here. These differences can be seen in the cross-sectional profiles of the diaphragm when the base changes from the "as formed condition" to the "activated condition" as well as the orientation of the diaphragm 12 in the post activation position. The tilted orientation of the central region 28 of the diaphragm in the activated position can function to "lock" the base 8 in the activated condition, in some embodiments. Due to the tilted orientation of the central region 28 after activation and stiffness of the linear portion 42, the base 8 may be more resistant to returning to the as-formed position.

The tilted orientation of the central region 28 in the post activation position of the diaphragm 12 additionally enables a visual identification of containers which have been properly sealed and activated. By means of "locking" the base 8 in the activated position in the above-described manner, the base 8 may be more resistant to returning to the as-formed position. This can be beneficial during the manufacturing process by preventing the diaphragm 12 from "pressing out" during brief periods of elevated pressure within the container 100, such as when the container reaches a pinch point during production that squeezes the sealed container and increases the pressure within the container.

Referring to FIGS. 1 and 14-20, a container body 110 will now be described in greater detail, in accordance with some embodiments. As noted above, the body 110 can include a plurality of cylindrical wall sections 114 interspersed with inwardly directed ribs 116 that are axially located between and separate adjacent wall sections 114. Each rib 116 extends radially inward between adjacent wall sections 114. Stated differently, each rib 116 can be described as a section of reduced diameter between adjacent wall sections 114 of relatively greater diameter. Although the container 100 shown in FIG. 1 includes four wall sections 114 between the base 8 and the upper body portion 113, it is to be appreciated that the number of wall sections 114 and ribs 116 can vary according to the desired properties of the container 100.

The wall sections 114 are coaxially aligned with each other along the central axis 6 and constitute a majority of the axial height of the body 110. The wall sections 114 can be formed such that the surface is smooth or textured. The generally vertically aligned parallel to the central axis 6. Alternatively, such as shown in FIG. 1, for example, the wall sections 114 can be formed such that the outer surface is sloped with respect to the central axis 6. In yet other embodiments, wall sections 114 can be substantially cylindrical but have different outer diameters so that, in combination, the body 110 has a waist 115 of reduced diameter. For example, the wall sections 114 of the container 100 shown in FIG. 1 have a frustoconical shape so that the body 110 slightly narrows near its middle region or waist 115.

To increase the strength of the body 110 and reduce the occurrence of collapse or bending at the ribs 116, the body includes a plurality of ribs 116 that extend circumferentially about body 110. The number of ribs 116 depends in part on the dimensions of the container 100 and its material thickness, among other factors. In some embodiments, a small container may only have a single rib 116. Numerous variations and embodiments will be apparent in light of the present disclosure.

As illustrated in FIG. 1, each rib 116 is located axially between two adjacent wall sections 114. Each of ribs 116 is formed as a circumferential channel having a reduced radial dimension compared the radial dimension of each adjacent wall section 114. Each rib 116 further includes a plurality of protrusions 118 that are spaced circumferentially, and which divide the rib 116 into a plurality of circumferential rib segments. In some embodiments, each rib 116 includes three or four protrusions 118 that are evenly distributed about the circumference of the rib 116. For example, the protrusions 118 are located at 120-degree or 90-degree intervals about the circumference of the rib 116. In other embodiments, the rib 116 can have as few as two protrusions 118 or more than four protrusions 118. In the example shown in FIG. 1, each rib 116 has four protrusions 118 spaced every 90°, where protrusions 118 of vertically adjacent ribs 116 each rib are circumferentially offset by 45 degrees. In this manner the protrusions 118 are arranged in a brick-like pattern.

Figure 14:
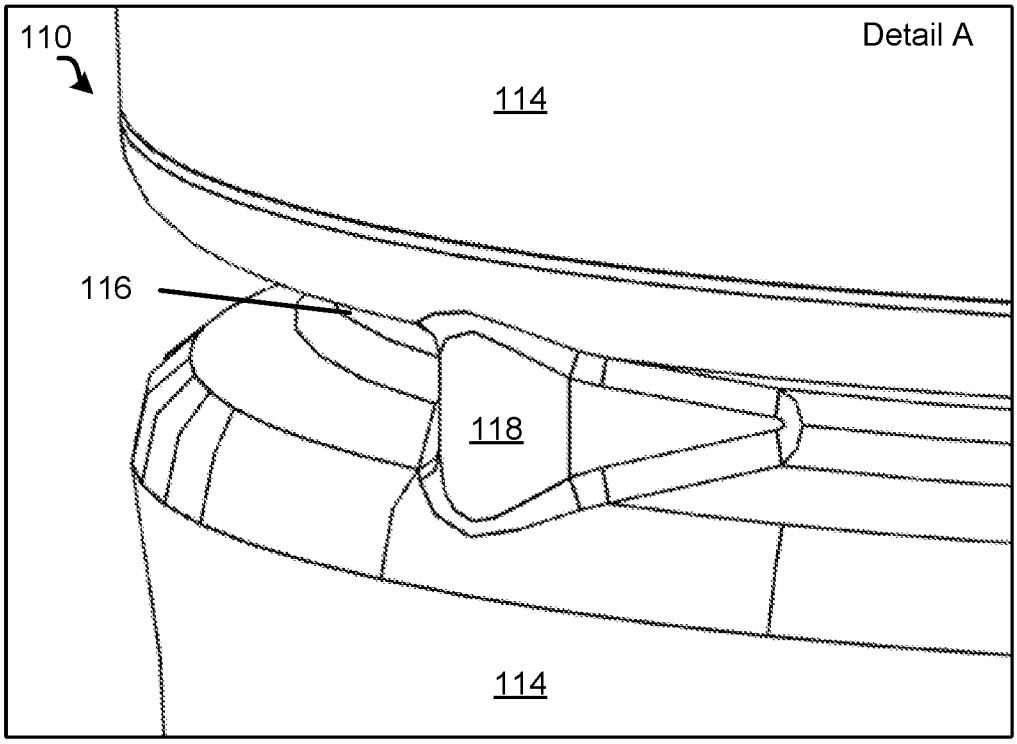
FIG. 14 is a close-up, perspective view of a rib and protrusion according to detail A of FIG. 1, in accordance with an embodiment of the present disclosure.

FIG. 14 illustrates a perspective view of part of a container body 110 and shows part of a rib 116 between body sections 114 as shown in detail A of FIG. 1. As shown here, the protrusion 118 has a wedge-like shape or V-shape that extends into the rib 116. Note that in this example the protrusion 118 is a deviation in the body 110 from the channel-like shape of the rib 116 rather than an additional structure installed in the rib 116. In other words, the material forming the rib 116 deviates to define the protrusion 118, where the wall sections, rib 116, and protrusion 118 are a single and continuous piece of plastic of the same or similar wall thickness. In other embodiments, the protrusion 118 can be made solid or can be made with increased wall thickness compared to the rib 116 and/or the adjacent wall sections 114.

FIG. 15 illustrates a side view of the protrusion 118 as shown in detail B of FIG. 1 and FIG. 16 illustrates a front view of the protrusion as shown in detail C of FIG. 1. FIG. 17 is a cross-sectional view of the protrusion 118 illustrated in FIG. 16 taken along section line 17-17. As shown, the protrusion 118 projects radially outward from the rib 116 to approximately the same or slightly less than the radial dimension of the adjacent wall sections 114.

Figure 18:
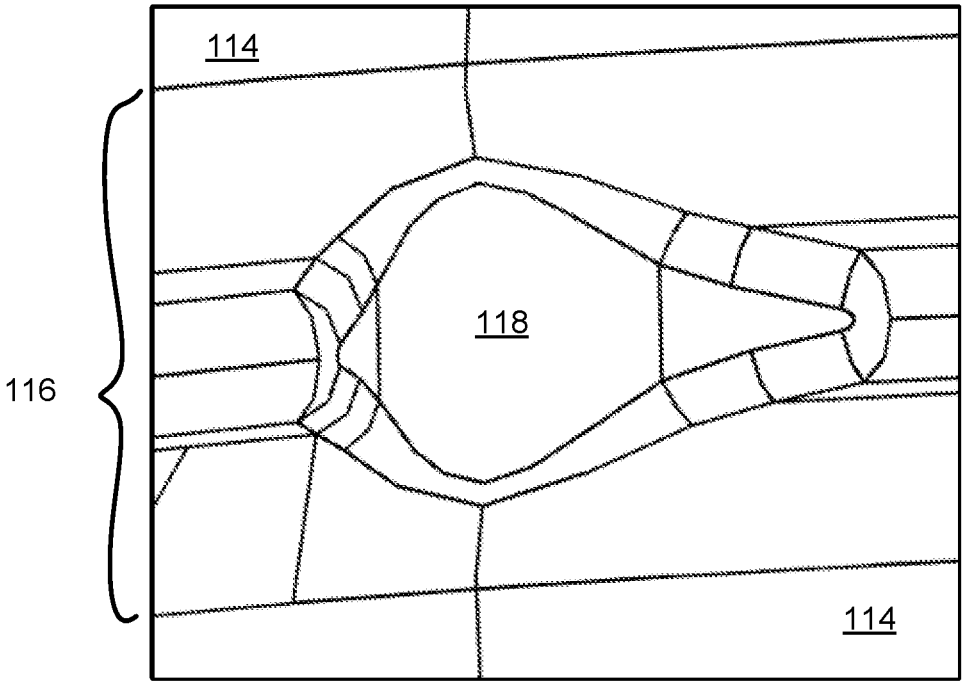
FIG. 18 is perspective view of a rib and protrusion as viewed from an interior of the plastic container, according to an embodiment of the present disclosure.
Figure 19:
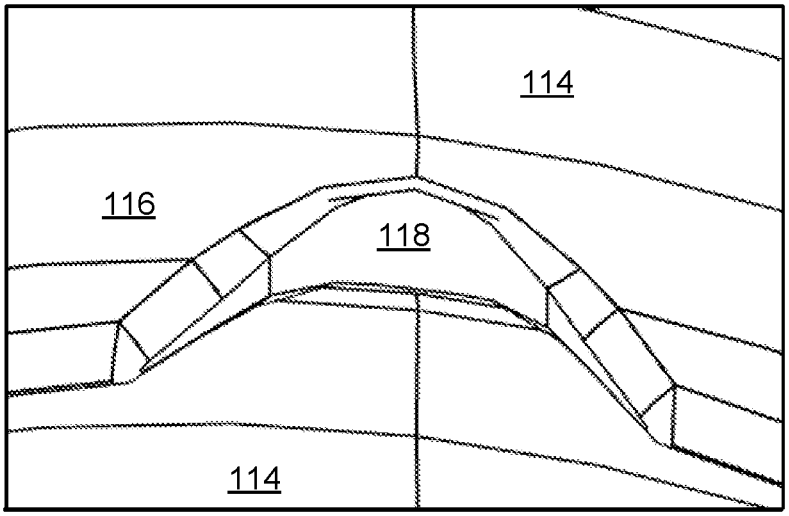
FIG. 19 is a top perspective view of the protrusion protruding outwardly as viewed from an interior of the plastic container of FIG. 18, according to an embodiment of the present disclosure.
Figure 20:
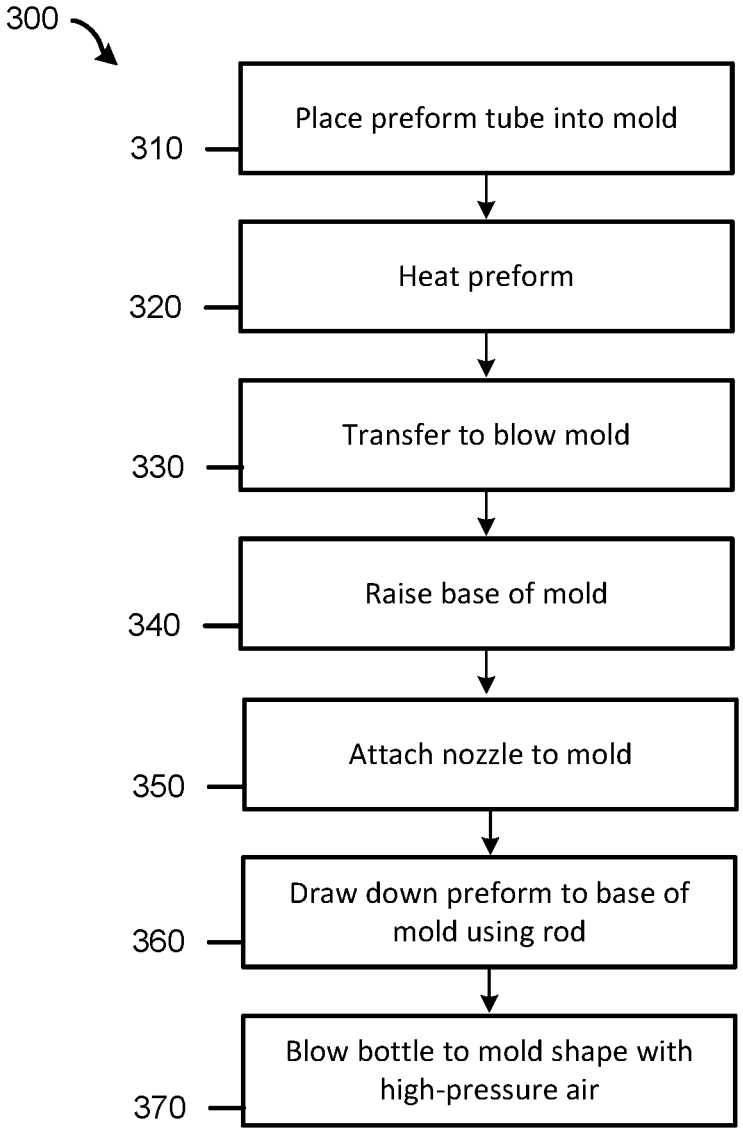
FIG. 20 is a flow diagram illustrating a process of manufacturing a plastic container according to the present disclosure.

FIGS. 18 and 19 illustrate perspective views of a protrusion 118 as viewed from inside the container, in accordance with an embodiment of the present disclosure. As shown, the protrusion 118 is a radially outward deviation from the otherwise channel shape of the rib 116 and has a wedge shape or V-shape.

The ribs function to maintain shape of the container and distribute forces on the container more uniformly. The ribs add vertical strength to prevent collapse of the container in the vertical direction. Protrusions 118 increase strength of the container body 110 and prevent the body 110 collapsing along the rib 116. Additionally, the ribs 116 between adjacent wall sections 114 and the brick-like arrangement of the protrusions 118 helps to prevent collapse of the container under compression forces (e.g., from stacking) and to maintain the vertical height of the container during changes of the internal pressure. Unlike ribs in some containers that lack protrusions and therefore enable the container to fold at the rib and enable vertical compression of the container, the ribs according to the present disclosure prevent folding and minimize vertical compression.

Method of Forming a Container

FIG. 19 illustrates processes in a method 300 of manufacturing a plastic container according to some embodiments of the present disclosure.

Specifically, the process is directed to forming a plastic container using a blow molding process, where the resulting container has a base with an inner wall extending upward from the contact ring and a diaphragm that curves downward from a hinge at the top of the inner wall to a central region, where the diaphragm can move axially in response to changes in pressure within the container. Initially, a preform tube is placed 310 into the cavity of an injection mold having a heating element and which can be controlled to precisely adjust the temperature of the preform tube. In some embodiments, the preform includes a threaded finish portion, where the mold retains the preform by securing around the finish portion.

Subsequently, the preform is heated 320 to soften the material. In one example, the plastic material is polyethylene terephthalate (PET or PETE). Infrared lamps are used to heat the preform to it glass transition temperature, or other temperature at which the material softens. For PET, the glass transition temperature is from 67-81° C.

Next, the heated preform is removed from the heating mold and positioned 330 within the blow mold cavity that defines the finished container shape. In some embodiments, the blow mold cavity has a clamshell construction.

Next, the base of the mold is raised 340 to correspond to the desired length of the finished container and is locked into the mold. In one example, the base moves axially within a cylindrical cavity in the blow mold.

Method 300 continues with attaching 350 a nozzle to the top of the mold and drawing 360 a stretch rod into the preform while also blowing 370 high pressure gas into the preform through the nozzle. In one embodiment, the gas is operated at about 600 psi. The stretch rod advances toward the bottom of the blow mold cavity causing the preform to extends from the top to adjacent the bottom of the blow mold cavity. During this process, pressurized gas is injected into the preform through the neck of the preform whereby the preform is stretched radially and axially outward against the blow mold cavity to form the container.

In some embodiments, the mold is configured to provide a relatively greater wall thickness along the container body and portions of the base, and a relatively lesser wall thickness along the diaphragm.

Further Example Embodiments

The following examples pertain to further embodiments, from which numerous permutations and configurations will be apparent.

Example 1 is a plastic container having a base portion adapted for vacuum absorption, the container comprising a base and a container body extending up from the base along a central axis to a finish portion defining a mouth. The base includes an outside wall, a chime connecting the outside wall to an annular contact ring, an inside wall extending upward from the contact ring to a hinge, and a diaphragm connected to the hinge. The diaphragm is movable between a first position and a second position in response to pressure change within the plastic container. The diaphragm includes a central region and a flexible wall around the central region, the flexible wall having a profile as viewed in cross section that curves downward and radially inward from the hinge to the central region.

Example 2 includes the subject matter of Example 1, where the flexible wall has a concave curvature as viewed in cross section and with respect to a plane of the annular contact ring.

Example 3 includes the subject matter of Example 1, where the inner wall extends linearly between the contact ring and the hinge.

Example 4 includes the subject matter of Example 3, where the inner wall extends upward at an angle of from 65° to 80° with respect to a plane of the annular contact ring.

Example 5 includes the subject matter of any of Examples 1-5, where the inner wall has an axial height of at least 0.400".

Example 6 includes the subject matter of Example 5, wherein the axial height is at least 0.450".

Example 7 includes the subject matter of any of Examples 1-6, where the flexible wall includes a first annular portion having a first radius of curvature and a second annular portion having a second radius of curvature less than the first radius of curvature. The second annular portion is radially between and connects to the first annular portion and to the central region.

Example 8 includes the subject matter of Example 7, where the second radius of curvature is from 0.15 to 0.25 inch when the diaphragm is in the first position.

Example 9 includes the subject matter of Example 7 or 8, where the second radius of curvature is from 0.18 to 0.22 inch.

Example 10 includes the subject matter of any of Examples 7-9, where the first radius of curvature is from 1.0-1.5 inches when the diaphragm is in the first position.

Example 11 includes the subject matter of Example 10, where the first radius of curvature is from 1.1-1.2 inches when the diaphragm is in the first position.

Example 12 includes the subject matter of any of Examples 7-11, where the second radius of curvature is maintained in the first position and in the second position, and where the first radius of curvature is reduced when the diaphragm moves from the first position to the second position.

Example 13 includes the subject matter of any of Examples 1-12, where the container body includes a plurality of wall sections interspersed axially with ribs having a reduced diameter compared to adjacent wall sections, where each of the ribs includes at least three protrusions distributed circumferentially and protruding radially outward between the adjacent wall sections.

Example 14 includes the subject matter of Example 13, where the container body includes at least four wall sections and at least three ribs, and where protrusions of axially adjacent ribs are circumferentially offset.

Example 15 includes the subject matter of any of Examples 13-14, where each of the protrusions generally has a wedge shape.

Example 16 includes the subject matter of any of Examples 1-15, where the first position is a pre-activation position, and the second position is a post-activation position.

Example 17 includes the subject matter of Example 16, where the pre-activation position is an as-formed position of the container.

Example 18 includes the subject matter of any of Examples 1-17, where the central region translates axially between the first position and the second position in response to the changes in pressure within the container.

Example 19 includes the subject matter of any of Examples 1-18, where in the first position the central region is axially closer to a plane of the annular contact ring than the flexible wall when the diaphragm is in the first position.

Example 20 includes the subject matter of any of Examples 1-18, where the central region is axially closer to a plane of the annular contact ring container compared to the flexible wall when the diaphragm is in the second position.

Example 21 includes the subject matter of any of Examples 1-20, where the container body has a first wall thickness, and the diaphragm has a second wall thickness that is less than the first wall thickness.

Example 22 includes the subject matter of any of Examples 1-18, where when the diaphragm is in the first position, the central region is axially closer to a plane of the contact ring, and when the diaphragm is in the second position, the central region is axially further away from the contact ring.

Example 23 includes the subject matter of any of Examples 1-18, where when the diaphragm is in the first position, the central region is axially farther away from a plane of the contact ring and when the diaphragm is in the second position, the central region is axially closer to the plane of the contact ring.

Example 24 includes the subject matter of any of Examples 1-23, where the container is made of polyethylene terephthalate (PET).

Example 25 is a plastic container having a base portion adapted for vacuum absorption, the container including a base and a container body extending up from the base along a central axis to a finish portion defining a mouth. The base includes an outside wall, a chime connecting the outside wall to an annular contact ring, an inside wall extending upward from the contact ring to a circular hinge, and a diaphragm connected to the circular hinge, where the diaphragm movable between a first position and a second position in response to pressure change within the plastic container. The diaphragm is asymmetric and includes a central region and a flexible wall around the central region, where the flexible wall includes a first portion having a curved cross-sectional profile between the central region and the hinge, a second portion having a linear cross-sectional profile between the central region and the hinge, and transition portions extending radially between the central region and the hinge and positioned circumferentially between the first portion and the second portion.

Example 26 includes the subject matter of Example 25, where the linear profile of the first portion curves downward and radially inward from the hinge to the central region.

Example 27 includes the subject matter of Example 24 or 25, where transition portions between the first portion and the second portion of the flexible wall include a first transition portion and a second transition portion arranged on opposite sides of the central region.

Example 28 includes the subject matter of Example 27, where the first transition portion includes a convex profile between the first portion and the second portion, and the second transition portion incudes a concave profile between the first portion and the second portion.

Example 29 includes the subject matter of any of Examples 25-28, where the first portion of the diaphragm has a concave curvature with respect to a plane of the annular contact ring.

Example 30 includes the subject matter of any of Examples 25-29, wherein when the diaphragm is in the first position the central region is axially closer to a plane of the annular contact ring than the flexible wall.

Example 31 includes the subject matter of any of Examples 25-30, where the inner wall extends linearly between the contact ring and the hinge.

Example 32 includes the subject matter of Example 31, where the inner wall extends upward at an angle of from 65° to 80° with respect to a plane of the annular contact ring.

Example 33 includes the subject matter of any of Examples 25-30, where the inner wall has a concavely curved profile between the contact ring and the hinge as viewed in cross section.

Example 34 includes the subject matter of any of Examples 25-33, where the first portion of the flexible wall includes a first radial portion having a first radius of curvature and a second radial portion having a second radius of curvature less than the first radius of curvature, and where the second radial portion is radially between and connects to the first radial portion and to the central region.

Example 35 includes the subject matter of Example 34, where the second radius of curvature is from 0.15 to 0.25 inch when the diaphragm is in the first position.

Example 36 includes the subject matter of Example 35, where the second radius of curvature is from 0.18 to 0.22 inch when the diaphragm is in the first position.

Example 37 includes the subject matter of any of Examples 34-36, where the first radius of curvature is from 1.0-1.5 inches when the diaphragm is in the first position.

Example 38 includes the subject matter of Example 37, where the first radius of curvature is from 1.1-1.2 inches when the diaphragm is in the first position.

Example 39 includes the subject matter of any of Example 34-38, wherein when the diaphragm moves from the first position to the second position the second radius of curvature decreases, and the first radius of curvature increases.

Example 40 includes the subject matter of any of Examples 25-39, where when the diaphragm moves from the first position to the second position the central region moves axially towards a top of the container.

Example 41 includes the subject matter of Example 40, where the central region is oriented perpendicular to the central axis when the diaphragm is in the first position and the central region is oriented transversely to the central axis when the diaphragm is in the second position.

Example 42 includes the subject matter of any of Examples 40 or 41, where the central region is positioned closer to a plane of the contact ring than the flexible wall when the diaphragm is in the first position.

Example 43 includes the subject matter of Example 42, where at least part of the central region is positioned axially closer the mouth of the container compared to the hinge, when the diaphragm is in the second position.

Example 44 includes the subject matter of any of Examples 25-44, where the container body has a first wall thickness, and the diaphragm has a second wall thickness that is less than the first wall thickness.

Example 45 includes the subject matter of any of Examples 25-44, where the container body includes a plurality of wall sections interspersed axially with ribs extending radially inward, wherein each of the ribs includes at least three protrusions distributed circumferentially along the rib and protruding radially outward between adjacent wall sections.

Example 46 includes the subject matter of Example 45, wherein the container body includes at least four wall sections and at least three radially inward ribs, wherein protrusions of axially adjacent ribs are circumferentially offset.

Example 47 includes the subject matter of Example 44-45, wherein each of the protrusions generally has a wedge shape.

Example 48 includes the subject matter of any of Examples 45-47, where at least some of the plurality of wall sections have an outer surface that is inclined with respect to the central axis.

Example 49 includes the subject matter of any of Examples 25-48, where the first position is a pre-activation position, and the second position is a post-activation position.

Example 50 includes the subject matter of Example 49, where the pre-activation position is an as-formed position of the container.

Example 51 includes the subject matter of any of Examples 25-50, where when the diaphragm is in the first position, the central region is axially closer to a plane of the contact ring, and when the diaphragm is in the second position, the central region is axially farther away from the plane of the contact ring.

Example 52 includes the subject matter of any of Examples 25-50, wherein when the diaphragm is in the first position, the central region is axially farther away from a plane of the contact ring, and when the diaphragm is in the second position, the central region is axially closer to the plane of the contact ring.

Example 53 includes the subject matter of any of Examples 25-52, where the container is made of polyethylene terephthalate (PET).

Example 54 includes the subject matter of any of Examples 25-53, where the inside wall has an axial height of at least 0.400".

Example 55 includes the subject matter of Example 54, where the axial height is at least 0.450".

Example 56 includes the subject matter of any of Examples 1-55, where the finish portion comprises exterior threads.

Example 57 includes the subject matter of Example 56, where the finish portion defines a mouth having a diameter of at least 0.75".

Example 58 includes the subject matter of Example 57, where the diameter is at least 1.0"

Example 59 includes the subject matter of Example 57, where the diameter is at least 1.5"

Example 60 includes the subject matter of Example 57, where the diameter is at least 2".

Example 61 includes the subject matter of Example 57, where the diameter is at least 2.5".

Example 62 includes the subject matter of any of Examples 1-61, where the container has a volume from 200 ml to 500 ml.

Example 63 includes the subject matter of any of Examples 1-61, where the container has a volume from 500 ml to 1500 ml.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A plastic container having a base portion adapted for vacuum absorption, the container comprising a base and a container body extending up from the base along a central axis to a finish portion defining a mouth, the base including an outside wall;

a chime connecting the outside wall to an annular contact ring;

an inside wall extending upward from the annular contact ring to a circular hinge; and a diaphragm connected to the circular hinge, the diaphragm movable between a first position and a second position in response to pressure change within the plastic container, the diaphragm including a central region and a flexible wall around the central region, wherein the flexible wall includes a first portion having a curved cross-sectional profile between the central region and the hinge, a second portion having a linear cross-sectional profile between the central region and the hinge, and transition portions extending radially between the central region and the hinge and positioned circumferentially between the first portion and the second portion.

2. The container of claim 1, wherein the inner wall extends linearly between the annular contact ring and the hinge.

3. The container of claim 1, wherein the transition portions between the first portion and the second portion of the flexible wall include a first transition portion and a second transition portion arranged on opposite sides of the central region, wherein the first transition portion includes a convex profile between the first portion and the second portion, and wherein the second transition portion incudes a concave profile between the first portion and the second portion.

4. The container of claim 1, wherein when the diaphragm is in the first position the central region is axially closer to a plane of the annular contact ring than the flexible wall.

5. The container of claim 1, wherein the first portion of the flexible wall includes a first radial portion having a first radius of curvature and a second radial portion having a second radius of curvature less than the first radius of curvature, wherein the second radial portion is radially between and connects to the first radial portion and to the central region.

6. The container of claim 5, wherein the second radius of curvature is from 0.15 to 0.25 inch and the first radius of curvature is from 1.1-1.2 inches when the diaphragm is in the first position.

7. The container of claim 1, wherein the central region is oriented perpendicular to the central axis when the diaphragm is in the first position and is oriented transversely to the central axis when the diaphragm is in the second position.

8. The container of claim 7, wherein the container body has a first wall thickness and the diaphragm has a second wall thickness that is less than the first wall thickness.

9. The container of claim 1, wherein the container body includes a plurality of wall sections interspersed axially with ribs extending radially inward, wherein each of the ribs includes at least three protrusions distributed circumferentially along the rib and protruding radially outward between adjacent wall sections, wherein protrusions of axially adjacent ribs are circumferentially offset.

* * * * *